US006015653A

United States Patent [19]

Nakahanada et al.

[11] Patent Number: 6,015,653

[45] Date of Patent: Jan. 18, 2000

[54] METHOD FOR PROCESSING TRANSPARENT SILVER HALIDE PHOTOGRAPHIC LIGHT-SENSITIVE MATERIAL AND PRODUCT THEREBY

[75] Inventors: Manabu Nakahanada; Wataru Satake, both of Hino, Japan

[73] Assignee: Konica Corporation, Tokyo, Japan

[21] Appl. No.: 09/299,464

[22] Filed: Apr. 26, 1999

[30] Foreign Application Priority Data

May 1, 1998 [JP] Japan ..... 10-137555
Jun. 2, 1998 [JP] Japan ..... 10-152853

[51] Int. Cl.[7] ..... G03C 7/30

[52] U.S. Cl. ..... 430/393; 430/372; 430/419; 430/428; 430/429; 430/430

[58] Field of Search ..... 430/393, 372, 430/419, 428, 429, 430

[56] References Cited

U.S. PATENT DOCUMENTS 5,298,370 3/1994 Kojima et al. ..... 430/455
5,338,648 8/1994 Kojima et al. ..... 430/455

*Primary Examiner*—Hoa Van Le
*Attorney, Agent, or Firm*—Frishauf, Holtz, Goodman, Langer & Chick, P.C.

[57] ABSTRACT

A method for processing a transparent silver halide color photographic material is disclosed. The transparent silver halide photographic light-sensitive material is treated with a processing solution containing a compound represented by Formula (I).

Formula I wherein Q is a group of atoms necessary for forming a nitrogen-containing heterocyclic ring (including one condensed with a 5- or 6-member unsaturated ring), $R_{11}$ is a hydrogen atom, an alkali metal atom, or an alkyl group, Q' is a synonym for $Q_1$.

After the treating, a ratio (E/G) of a light absorbance E of unexposed area of the light-sensitive material at 650 nm to an amount of silver G mg/m$^2$ remaining in the light-sensitive material is within the range of from $3.0\times10^{-4}$ to $1.5\times10^{-3}$ in the silver halide photogrpahic light-sensitive material, A transparent silver halide color photographic material is also disclosed.

10 Claims, No Drawings

METHOD FOR PROCESSING TRANSPARENT SILVER HALIDE PHOTOGRAPHIC LIGHT-SENSITIVE MATERIAL AND PRODUCT THEREBY

FIELD OF THE INVENTION

The present invention relates to a method for processing a transparent silver halide color photographic material, hereinafter referred to a color light-sensitive material for simplifying, and a product thereof produced by processing the transparent silver halide color photographic material, particularly relates to a method for processing a transparent silver halide color photographic material and a product thereof by which a suitable print can be obtained with no influence on the image density even when coated silver halide is remained in the processed transparent silver halide color photographic material. The invention further related to a method for processing a transparent thereof by which no problem is caused on the storage ability of image and a suitable print can he obtained even when coated silver halide is remained in the processed transparent silver halide color photographic material.

BACKGROUND OF THE INVENTION

London Treaty has been entered according to the trend of protection of environment of the earth, and dumping waste photographic processing liquids into ocean has been substantially prohibited. Accordingly, efforts to reduce the photographic waste liquids have been made in the field of photography. Regarding the fixing solution, reduction of the waste liquid and that of the replenishing amount have been studied as shown in Japanese Patent Publication Open to Public Inspection (JP O.P.I.) no. 8-201997.

Besides, increasing in the sensitivity of color film has been progressed accompanied with a prompt growth of demand for a film with lens and spread of a camera with a zoom function. Such the high speed film usually has a high silver iodide content and coated silver amount. As a result of that, the load on the treating process, particularly on the bleaching process, has become a problem.

Furthermore, an ammonium salt such as ammonium thiosulfate and ammonium thiocyanate is used as a fixing agent to be used in the fixing solution from the viewpoint of a clearing time. However, degradation of working environment has been made since such the ammonium slat forms ammonia gas when the pH of the fixing solution is exceeded to 7, and the ammonia gas drifts around the automatic processor and causes displeasure order. Particularly, the problem is made serious if the automatic processor is installed in a badly ventilated place such as a foods store in a basement of a building. The fixing tends to made insufficient when a receipt in which the amount of ammonium salt is reduced as small as possible is applied as a countermeasure of such the problem.

Moreover, the fixing solution is with circulation in the treating tang of the automatic processor for purposes of uniforming the temperature, removing dust in the tank and stirring the solution. However, contact of the fixing solution with air is accelerated by the circulation and the fixing solution tends to be oxidized. The oxidation of the fixing solution causes formation of sulfurized substance and a serious problem is raised when the sulfurized substance is adhered to the light-sensitive material. Such the problem is made more serious when the replenishing amount is reduced. An insufficient fixation is caused when the circulation is reduced as a countermeasure to such the problem.

In the silver removing process in which silver halide and metallic silver in the light-sensitive material is removed into a processing solution, silver halide tends to be remained in the light-sensitive material in a form of unfixed silver which causes insufficient fixation. Such the insufficient fixation is caused by raising the accumulated silver amount in the processing solution caused by reduction of the replenishing amount or processing a light sensitive material having a high coated silver amount, the use of a fixing solution having a reduced ammonium ion content, and the use of an automatic processor with reduced circulation.

When the insufficient fixation is formed in a color light-sensitive material, a color remaining stain is formed since a dye is remained accompanied with a lot of silver remaining in the light-sensitive material. A serious problem such as change in the tone of the light-sensitive material and degradation in the image quality is raised at the print of image when such the color stain is formed. It is usual in a mini-lab that various level of conditions (channels) suited for various light-sensitive materials are previously set using a standard negative film and the printing of a kind of film is performed by using the channel suited to such the film. For such the procedure, it is necessary that the negative is constantly finished. Accordingly, color prints having a constant quality cannot be obtained when the color stain is formed since the density of the negative is varied. The insufficient fixation usually tends to be formed ununiformly. In such the case, the quality of print is considerably degraded.

On the other hand, a method is disclosed in JP O.P.I. No. 8-29930 in which the majority of coated silver is remained in the part of undeveloped part other than image formed part of a monochromatic light-sensitive material. In the monochromatic light-sensitive material, however, such the problem is not made serious since the problem of the color stain and that prints having a constant quality is prepared by a printer are hardly raised in the monochromatic light-sensitive material.

It is difficult to solve the above-mentioned problems regarding the fixing process of color light-sensitive material since in the color light-sensitive material, the reduction of replenishing of the fixing process, the reduction of the ratio of ammonium ion and the reduction of the circulation in an automatic processor are difficult because it is necessary to perfectly remove the silver hailed from the light-sensitive material from the viewpoint of the color stain.

Recently, a high-speed color negative film having a high amount of coated silver is frequently used, and the replenishing in the fixing process is reduced. Therefore, silver halide tends to be remained in a form of unfixed silver in the light-sensitive material and tend to cause an insufficient fixation. A large amount of silver halide is remained in the light-sensitive material when the insufficient fixation is occurred, and the silver salt is changed to black silver by heat, moisture of light, or the silver halide is reacted by thiosulfate remained in the light-sensitive material to form silver sulfide after the processing. When the black silver or silver sulfide is formed in a negative film, problems such as change in the tone of the light-sensitive material and degradation in the image quality are raised after storage, and serious problems are caused at the printing of the image in the future.

Moreover, a demand of reducing replenishing amount is also raised in the processing of a color paper, and an insufficient fixation tends to be occurred when the replenishing is reduced, and the degradation of storage ability image is feared.

As above-mentioned, it has been common knowledge that silver halide in light-sensitive material is completely removed for reducing the replenishment in the fixing process. Besides, the storage ability of image can be improved by the invention in which unfixed silver is stabilized by the use of specific compound and silver salt is positively remained in the light-sensitive material.

On the other hand, a method is disclosed in JP O.P.I. No. 8-29930 in which the majority of coated silver is remained in the part of undeveloped part other than image formed part of a monochromatic light-sensitive material. However, the problem of the storage ability of dye image at the image forming portion of color light-sensitive material is not raised since the image is formed by silver, not dye, in the monochromatic light-sensitive material. Accordingly, the problem to be solved in this publication is quite different from the invention, and there is no description suggesting the invention in the publication.

The above-mentioned insufficient fixation of negative film tends to be unevenly formed on the film, and a serious problem is raised since the unevenness on the negative is printed on the color paper when the negative is printed on the paper. It has been found by the inventors that a suitable print can he obtained, even when the silver salt is remained in the light-sensitive material, by removing the influence of the silver salt on the transmitting light by the use of the compound of the invention. The problem of the unevenness insufficient fixation also can be soled.

SUMMARY OF THE INVENTION

The object of the invention is to provide a method for processing a transparent silver halide photographic color light-sensitive material and a product of transparent silver halide photographic color light-sensitive material by which the formation of the color stain in the image forming potion is inhibited when the replenishing amount of the fixing solution and the ratio of ammonium ion are reduced, the performance of printer can be fully played, and a stable processing ability without formation of unevenness of image can be obtained when the circulation in the fixing tank is reduced.

The above-mentioned object of the invention is attained by the following method for processing a transparent silver halide color photographic material and product of the halide color photographic material processed according to the method. The method for processing a transparent silver halide color photographic material comprises the step of treating the transparent silver halide photographic light-sensitive material with a processing solution containing a compound represented by the following Formula [I], wherein after the processing, a ratio (E/G) of a light absorbance E of unexposed area of the light-sensitive material at 650 nm to an amount of silver G mg/m$^2$ remaining in the light-sensitive material is within the range of from $3.0\times10^{-4}$ to $1.5\times10^{-3}$ in the silver halide photogrpahic light-sensitive material after completion of all processings.

Formula I

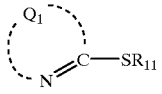

wherein Q is a group of atoms necessary for forming a nitrogen-containing heterocyclic ring (including one condensed with a 5- or 6-member unsaturated ring), $R_{11}$ is a hydrogen atom, an alkali metal atom,

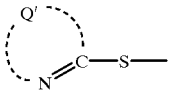

or an alkyl group, Q' is a synonym for $Q_1$.

The processing solution is preferably selected from a group consisting of a processing solution having a bleaching ability, a processing solution having a fixing ability and a stabilizing solution.

The method mentioned above, the processing solution is preferably a bleaching solution or a fixing solution.

The n amount of the compound represented by Formula (I) is preferably from 0.0001 to 0.1 moles/liter.

The preferable processing solution is a fixing solution and the replenishing amount for the fixing solution is preferably not more than 900 ml/m$^2$.

In the fixing solution the ratio of ammonium ion to the total cations is preferably not more than 50%.

The circulating ratio in the fixing tank is preferably from 0.2 to 0.8.

A transparent silver halide color photographic material of the invention is processed by step of treating the transparent silver halide photographic light-sensitive material with a processing solution containing a compound represented by Formula (I), wherein after the treating, a ratio (E/G) of a light absorbance E of unexposed area of the light-sensitive material at 650 nm to an amount of silver G mg/m$^2$ remaining in the light-sensitive material is within the range of from $3.0\times10^{-4}$ to $1.5\times10^{-3}$ in the silver halide photogrpahic light-sensitive material, Formula I

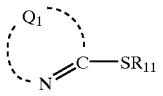

wherein Q is a group of atoms necessary for forming a nitrogen-containing heterocyclic ring (including one condensed with a 5- or 6-member unsaturated ring), $R_{11}$ is a hydrogen atom, an alkali metal atom,

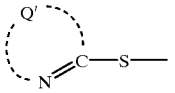

or an alkyl group, Q' is a synonym for $Q_1$.

A transparent silver halide color photographic material preferably contains a complex composed of the compound represented by Formula (I) and silver.

The amount of the complex is 1 to 10 mg/cm$^2$ converted to silver.

DETAILED DESCRIPTION OF THE INVENTION

The inventors attain by their study to stabilize unfixed silver halide and to positively remain silver halide in the light-sensitive material by the above-mentioned constitution of the invention. It has been found that a suitable print can be obtained without any influence of on the transferred light and that the problem of unevenness of insufficient fixation can be solved at the same time by the constitution even when the replenishing is reduced in a degree not realized until now, a fixing solution having a reduced of ammonium ion ratio is used and an automatic processor in which the circulation is reduced is used.

A processing method is disclosed in, for example, JP O.P.I. No. 8-29930 in which the majority of coated silver is remained in the part of undeveloped part other than image formed part of a monochromatic light-sensitive material. However, such the technology is quite different from this invention since the problem of the color stain and that prints having a constant quality is prepared by a printer are hardly raised in the monochromatic light-sensitive material.

In the invention the "product of transparent silver halide color photographic light-sensitive material" means a product of transparent color photographic product obtained by processing a transparent silver halide color photographic light-sensitive material, namely, a transparent color photographic product to be used for printing an color image to a printing paper or a transparent color photographic product to he appreciated by transparent light.

In the invention, the "transparent silver halide color photographic light-sensitive material" means a transparent silver halide color photographic light-sensitive material capable of giving the above-mentioned "product of transparent silver halide color photographic light-sensitive material" or the transparent color photographic product after processing.

In the invention, the "color light-sensitive material" means a light-sensitive material forming an image by a dye image instead of a silver image.

In the invention, In the invention, the light absorbance at 650 nm is that measured by setting a specimen cut out in a size of 3×4.5 cm from the unexposed area of processed transparent light-sensitive material on a film holder of a spectral photometer UV-160A, manufacture by Shimadzu Seisakushyo Co., Ltd., and measuring with no reference.

The amount of silver remaining in the light-sensitive material is measured by a fluorescent X-ray analyzer manufactured by Rigaku Denki Kogyo Co., Ltd.

In the transparent silver halide color photographic light-sensitive material and the method for processing the transparent silver halide color photographic light-sensitive material of the invention, the transparent silver halide color photographic light-sensitive material of the invention after processing (the transparent color photographic product) has a value of ((light absorbance at 650 nm of unexposed area)/(remaining silver amount (mg/m$^2$)) of from $3.0\times10^{-4}$ to $1.50\times10^{-3}$, preferably from $3.5\times10^{-4}$ to $1.00\times10^{-3}$. It is necessary that the light absorbance at 650 nm of unexposed area is not more than 1.0.

The compounds essentially to be used in the invention which is represented by Formula I, hereinafter referred to the compound by the invention, are described below.

Examples of preferable compound represented by Formula I are shown below.

I-1

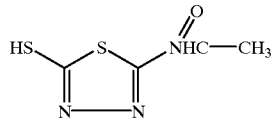

I-2

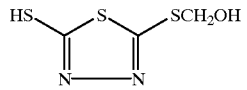

I-3

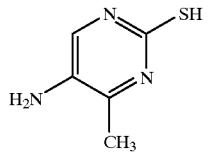

I-4

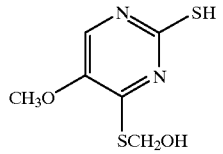

I-5

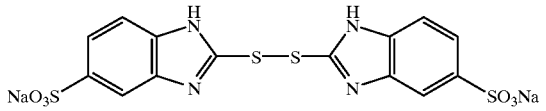

I-6

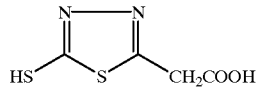

I-7

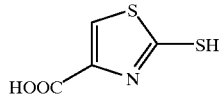

I-8

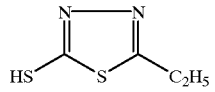

I-9

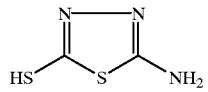

I-10

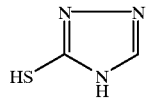

I-11

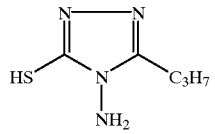

-continued

I-12

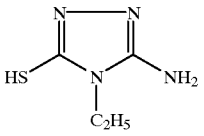

I-13

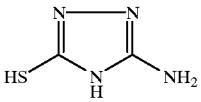

I-14

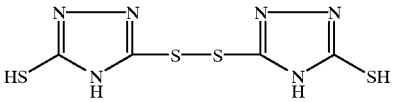

I-15

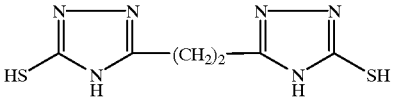

I-16

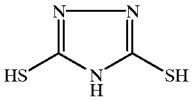

I-17

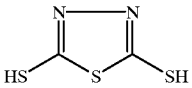

I-18

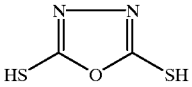

I-19

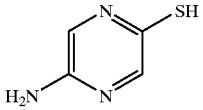

I-20

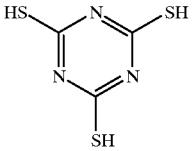

I-21

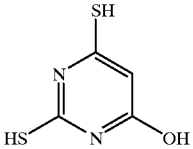

I-22

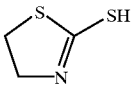

-continued

I-23

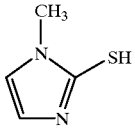

I-24

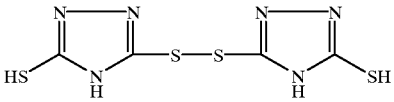

I-25

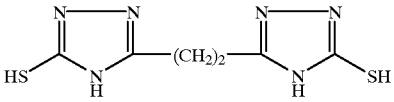

Among the above compounds, I-9, I-10, I-13, I-22 and I-23, are preferably used. Particularly preferable compound includes I-10, I-13 and I-23. These compounds may be used singly or in combination. The compound is preferably added to two or more kinds of processing solution for enhancing the effect of the invention. When the compound is added to two or more kinds of processing solution, the kind of the compound may be the same or different from each other.

The dye can be effectively removed by the compound of the invention even when silver is remained. It is supposed that the compound accelerates a exchange reaction with the dye since it has a high adsorption force with silver halide and form a complex with silver halide. As a result, an influence on the transparent light is quite disappeared and a good print can be obtained.

The compound of the invention prevents change of silver salt to blackened silver by heat, moisture or light, formation of silver sulfide by reaction of silver halide with thiosulfate remaining in the processed light-sensitive material and formation of stain caused by the color developing agent slightly remaining in the light-sensitive material, and a suitable print can be obtained without influence of remained silver on the transmitted light.

In the invention, although the processing solution in which the compound of the invention to be added may be any processing solution to be used for processing the silver halide photographic light-sensitive material, the compound of the invention is preferably added to a processing solution to be used at the later half of the processing. It is more preferable that the compound of the invention is added into one of a processing solution having a bleaching ability, a processing solution having a fixing ability and a stabilizing solution, or that the compound is added into all the processing solution having a bleaching ability, the processing solution having a fixing ability and the stabilizing solution. It is most preferably to add the compound of the invention into one of the processing solution having a fixing ability or the stabilizing solution.

When the compound of the invention is added into the processing solution having a bleaching ability, the amount of the compound of the invention is preferably from 0.0001 to 0.1 moles/liter, more preferably from 0.005 to 0.07 moles/liter, most preferably from 0.01 to 0.05 moles/liter, form the viewpoint of the effect of the invention and the precipitation of the compound.

When the compound of the invention is added into the processing solution having a fixing ability, the amount of the compound of the invention is preferably from 0.0001 to 0.1 moles/liter, more preferably from 0.001 to 0.05 moles/liter, most preferably from 0.005 to 0.03 moles/liter, form the viewpoint of the effect of the invention and the precipitation of the compound.

When the compound of the invention is added into the processing solution for stabilization, the amount of the compound of the invention is preferably from 0.0001 to 0.1 moles/liter, more preferably from 0.005 to 0.03 moles/liter, most preferably from 0.001 to 0.01 moles/liter, form the viewpoint of the effect of the invention and the precipitation of the compound.

In the invention, a amount of silver is remained as non-fixed silver in the processed light-sensitive material so that the ratio of the light absorbance of an unexposed portion at 650 nm to the remaining amount of silver (mg/m$^2$) is within the range of the following Equation A.

Equation A $$3.0\times10^{-4}<((\text{Light absorbance of an unexposed portion at 650 nm})/(\text{Remaining silver amount (mg/m}^2))\leqq1.5\times10^{-3}$$

Provided that the light absorbance of an unexposed portion at 650 nm$\leqq$1.0.

Preferably concrete processing steps of the processing method relating to the invention are shown below.

(1) Color developing→Bleaching→Fixing→Washing
(2) Color developing→Bleaching→Fixing→Washing→Stabilizing
(3) Color developing→Bleaching→Fixing→Stabilizing
(4) Color developing→Bleaching→Fixing→Stabilizing→2nd Stabilizing
(5) Color developing→Bleaching→Bleach-fixing→Washing
(6) Color developing→Bleaching→Bleach-fixing→Washing→Stabilizing
(7) Color developing→Bleaching→Bleach-fixing→Stabilizing
(8) Color developing→Bleaching→Bleach-fixing→1st Stabilizing→2nd Stabilizing
(9) Color developing→Bleaching→Bleach-fixing→Fixing→Washing→Stabilizing
(10) Color developing→Bleaching→Bleach-fixing→Fixing→1st Stabilizing→2nd Stabilizing
(11) Color developing→Bleach-fixing→Stabilizing
(12) Color developing→Bleaching→1st Fixing→2nd Fixing→Stabilizing
(13) Color developing→Bleaching→Fixing→1st Stabilizing→1st Stabilizing→2nd Stabilizing→3rd Stabilizing Among these processes (3), (4), (7), (10), (12), and (13) are preferable, and (3), (4) and (13) are particularly preferable.

The replenishing amount of the process having a fixing ability is preferably not more than 900 ml/m$^2$ for enhancing the effect of the invention since the accumulated silver amount tends to increase and the remaining silver in the light-sensitive material is easily formed when the replenishing amount particularly preferably from 100 to 700 ml/m$^2$, most preferably from 150 to 450 ml/m$^2$.

It is preferable for reducing the replenishing amount and improving the storage ability of image that the processing solution taken out from the fixing tank is introduced into the processing tank just before the stabilizing process.

In the embodiment of the invention, the color developing process, the process having a bleaching ability, the process having a fixing ability and the stabilizing process may be constituted according to an usual manner. For example, the color developing process described in JP O.P.I. No. 5-224373, the process having a bleaching ability described in JP O.P.I. No. 9-90579, and the process having a fixing ability and the stabilizing process described in JP O.P.I. No. 8-201997 may be applied.

The circulating ratio in the fixing tank according to the invention is preferably within the range of from 0.2 min$^{-1}$ (or round/min) to 0.8 min$^{-1}$, more preferably within the range of from 0.4$^{-1}$ to 0.6 min$^{-1}$. The circulating ratio is a ratio of the circulating amount of processing solution to the volume of the tank. For example, the circulating ratio is 0.5 if the circulation amount of the processing solution is 3 liters/minutes and the volume of processing tank is 6 liters.

In the invention, silver halide in an amount of 1% to 50% by weight of the coated silver halide on the light-sensitive material is remained in the processed light-sensitive material. It is preferable that the amount of the remained silver is from 2% to 30%, more preferably from 2% to 15%, by weight of the coated amount of silver halide. A magnetic recording layer may be provided on the non-emulsion coated surface of the light-sensitive material.

Although silver halide coated on the light-sensitive material to be processed may be silver chloride, silver chlorobromide, silver bromide, silver iodide and silver iodochloride, a light-sensitive material having a silver iodide content of from 0.5 mole-% to 10 mole-% of the whole silver halide such as a light-sensitive material for photographing is preferable. Furthermore, a light-sensitive material having a silver iodide content of from 3 mole-% to 8 mole-% of the whole silver halide is more preferable.

In the case of color paper, silver halide having a high silver chloride content is preferably used. The content of silver chloride in such the light-sensitive material is preferably not less than 80 mole-%, more preferably not less than 90 mole-%, most preferably not less than 99 mole-%, of the total silver halide.

The amount of silver coated on the light-sensitive material before processing is preferably from 2,000 mg/m$^2$ to 7,000 mg/m$^2$, more preferably from 4,000 mg/m$^2$ to 6,000 mg/m$^2$ when the emulsion is one having a high silver iodide content.

The amount of silver coated on the light-sensitive material before processing is preferably from 200 mg/m$^2$ to 700 mg/m$^2$, more preferably from 400 mg/m$^2$ to 600 mg/m$^2$ when the emulsion is one having a high silver chloride content.

In the invention, a tabular silver halide grain is preferably used in the light-sensitive material. The tabular silver halide grain in the invention, hereinafter referred to a tabular grain, is a grain having two parallel major surfaces, and the ratio of the circle corresponding diameter, the diameter of a circle having the same area as the projection area of the grain, of the major surface to the distance between the surfaces, thickness of the grain, or the aspect ratio is 5 or more.

It is preferable for a rapid processing that the tabular grain having an aspect ratio of 5 or more accounts for not less than 50%, more preferably not less than 8%, of the total of the projected area of the whole grains.

The diameter of the tabular grain is preferably from 0.3 to 10 $\mu$m, more preferably from 0.5 to 5.0 $\mu$m, further preferably from 0.5 to 2.0 $\mu$m, to obtain a required sensitivity. The thickness of the grain is preferably from 0.05 to 0.8 $\mu$m, more preferably from 0.1 to 3.0 $\mu$m. It is found that the range of surface area by the above-mentioned diameter and thickness of grain is suitable for a rapid processing.

The tabular grain of the invention has at least tow phases in the grain different from each other in the halogen composition, and the silver iodide content of the layer having the largest silver iodide content other than the outermost layer is not less than 3 mole-% and less than 15 mole-%, preferably not less than 3 mole-% and less than 10 mole-%, more preferably not less than 5 mole-% and less than 8 mole-%. The volume ratio of such the phase in the grain is preferably from 30% to 90%, more preferably from 30% to 60%.

The silver iodide content of the outermost layer of the tabular grain of the invention is preferably not less than 6 mole-% and less than the solid solubilizing limit. The content of less than 6 mole-% is not preferred since the storage stability relating to the adsorption of sensitizing dye is degrade.

The outermost layer in the invention is an area including the surface area of the grain. However, it is not necessary that the outermost layer completely cover the interior phase. The outermost layer in the invention is an area having a thickness of at least 10 atoms.

Regarding the number of the dislocation line, it is preferable that the grains each having five or more dislocation lines account for 50% or more, more preferably 80% or more, of the total projection area of the whole silver halide grains contained in the emulsion. The number of the location line is more preferably 10 or more. In the invention, the presence of dislocation line is advantageous to a high sensitivity, a resistivity against pressure and a stability of processing, and the effects are lowered when the number of dislocation line is less than 5. The number of dislocation line is preferably larger, and there is no upper limit.

When the dislocation lines are existed at the interior and the fringe of the grain, it is preferable that five or more dislocation lines at the interior portion, and more preferable that five or more dislocation lines are in both of the fringe portion and the interior portion of the grain, respectively.

In the invention, the oleophilic photographic composition is a substance substantially insoluble in water, concretely a high-boiling organic solvent, and a substance which is dispersed in the same manner as or together with the high-boiling organic solvent for adding into the light-sensitive material. Examples of the oleophilic photographic composition includes an UV absorbent, a color contamination preventing agent, an oxidation preferring agent, a stain preventing agent, and a dispersed substance to be added into the hydrophilic colloid binder such as an oil-soluble copular and a DIR coupler.

As the high-boiling organic solvent is usually ones having a boiling point at an ordinary pressure of from 180° C. to 350° C.

In the invention, an optional known method may be applied for adding the oleophilic photographic component to the light-sensitive material. In a typical procedure, one or more kinds of compounds for forming a oil droplet such as the high-boiling organic solvent are dissolved with the later-mentioned photographic additives according to necessity, and furthermore, according to necessity, dissolved in a low-boiling organic solvent such as methyl acetate, ethyl acetate, propyl acetate, butyl acetate, butyl propionate, cyclohexanol, dimethylene glycol monoacetate, nitromethane, carbon tetrachloride, chloroform, cyclohexanetetrahydrofuran, methyl alcohol, ethyl alcohol, propyl alcohol, fluorinated alcohol, acetonitrile, dimethylformamide, dioxane, acetone, methyl ethyl ketone and methyl isobutyl ketone (the low-boiling solvent may be used singly or in combination). The solution is mixed with a solution of a hydrophilic colloid such as gelatin containing an anion surfactant such as an alkylbenzenesulfonic acid and an alkylnaphthalenesulfonic acid, and/or a nonionic surfactant such as a sorbitol sesquioleic acid ester and sorbitol monolauric acid ester, and dispersed by a high speed rotating mixer, a colloid mill or an ultrasonic dispersing apparatus. Thus obtained dispersion is added to a coating liquid containing a hydrophilic colloid substance, and the liquid is coated on a support or on the layer such as a silver halide emulsion layer coated on a support. A compound capable of forming an oil droplet may be directly added to the coating liquid in a form of solution in the low-boiling organic solvent.

The low-boiling organic solvent is evaporated and almost not remained in the binder after coating and drying.

The oil-soluble coupler includes a yellow coupler, a magenta coupler, and a cyan coupler each forms a color image by a color development.

The coupler usable in the invention include the following compounds.

The yellow coupler includes a benzoylacetoanilide type coupler, a pyvaloylacetoanilide type coupler and a 2-equivalent coupler in which the carbon atom at the coupling position has a substituent capable of releasing upon coupling reaction (so-called a split-off group). The magenta coupler includes a 5-pyrazolone type coupler, a pyrazolotriazole type coupler, pyrazolinobenzimidazole type coupler, indazolone type coupler and a 2-equivalent magenta coupler having the split-off group.

The cyan coupler includes a phenol type coupler, a naphthol type coupler, and a 2-equvalent coupler having the split-off group.

In the invention, a white coupler which is oil-soluble and does not form a color dye even when it is reacted with the oxidation product of a color developing agent, is preferably used as a coupler incorporated in the oil droplet.

The light-sensitive material contains a color contamination preventing agent in a light insensitive layer as the oleophilic photographic component. The color contamination preventing agent includes the compounds described in Japanese Patent Application No. 4-19048 which react with does not with the oxidation product of a color developing agent and does not contribute to the image density. Concrete example of that include hydroquinone type compound (H-1 to H-18 in Japanese Patent Application No. 4-19048), pyrogallol type compounds, catechol type compounds (P-1 to P-16 in Japanese Patent Application No. 4-19048) sulfonylamino type compounds S-1 to S-19 in Japanese Patent Application No. 4-19048), coupling type compounds (CP-1 to CP-23) and hydrazine compounds (HZ-1 to HZ-14).

In the invention, a ratio of the whole weight of the oleophilic photographic component to the weight of gelatin is preferably 0.50 to 0.70, more preferably from 0.50 to 0.65. The coating amount of gelatin is preferably from 14.0 to 18.0 g/m$^2$ more preferably from 15.0 to 17.0 g/m$^2$.

EXAMPLES

Example 1

(Preparation method of light-sensitive material)

An emulsion of seed crystal was prepared in the following manner.

A silver nitrate aqueous solution (1.161 moles) and a solution of mixture of potassium bromide and potassium iodide (content of potassium iodide of 2 mole-%) were added to the following Solution A held at 35° C. by a double-jet method spending 2 minutes using a stirrer mixing apparatus described in Japanese Patent Nos. 58-58288 and 58-58289 while the silver electrode potential (measured by a silver ion selecting electrode using a saturated silver-silver chloride electrode as a comparative electrode) was maintained at 0 mV to form nuclei. Then the temperature was raised by 60° C. spending 60 minutes, and pH was adjusted to 5.0 by an aqueous solution of sodium carbonate. To the emulsion, an aqueous silver nitrate solution (5.902 moles) and an aqueous solution of mixture of potassium bromide and potassium iodide (potassium iodide of 2 mole-% were added by a double-jet method spending 42 minutes while the silver electrode potential was maintained at 9 mV. After the addition, the emulsion was desalted and washed by an usual flocculation method in the course of lowering the temperature to 40° C.

Thus obtained seed crystal emulsion is an emulsion comprising silver halide grains having an average sphere corresponding diameter of 0.24 μm, an average aspect ratio of 4.8 and hexagonal tabular grains having the maximum side ratio of from 1.0 to 2.0 account for not less than 90% of the total projection area of the silver halide grains. The emulsion was referred to Seed Crystal Emulsion-1.

| | |
|---|---|
| Ossein gelatin | 24.2 g |
| Potassium bromide | 10.8 g |
| $HO(CH_2CH_2O)_m(CH(CH_3)CH_2O)_{19.8}(CH_2CH_2O)_nH$ (m + n = 9.77) (10% methanol solution) | 6.78 ml |
| 10% nitric acid | 114 ml |
| $H_2O$ | 9657 ml |

Preparation fine grain silver iodide emulsion SMC-1

Two liters of an aqueous solution containing 7.06 moles of silver nitrate and 2 liters of an aqueous solution containing 7.06 moles of potassium iodide were added to 5 liters of an aqueous solution containing 6.0% by weight of gelatin and 0.06 moles of potassium iodide spending 10 minutes while vigorously stirring. In the course of addition, the pH was controlled at 2.0 using nitric acid and the temperature was held at 40° C. After formation of grains, pH was adjusted to 5.0 by an aqueous solution of sodium carbonate. The average diameter of thus obtained silver iodide fine grains was 0.05 μm. The emulsion was referred to SMC-1.

Preparation of Emulsion Em-1

Seven hundreds milliliters of an aqueous solution containing Seed Crystal Emulsion-1 in an amount corresponding to 0.178 moles, 0.5 ml of 10% methanol solution of $HO(CH_2CH_2O)_m(CH(CH_3)CH_2O)_{19.8}(CH_2CH_2O)_nH$ (m+n=9.77) and 4.5% by weight of gelatin was maintained at 75° C. and the pAg and pH are adjusted to 8.9 and 5.0, respectively. Grains were formed by the following procedure using a double-jet method while vigorously stirring the solution.

1) To the solution, 2.1 moles of aqueous solution of silver nitrate, 0.195 moles of SMC-1 and an aqueous solution of potassium bromide were added while the pAg and pH was maintained at 8.9 and 5.0, respectively.

2) Then 1.028 moles of aqueous solution of silver nitrate, 0.032 moles of SMC-1 and an aqueous solution of potassium bromide were added while the pAg and pH was maintained at 8.9 and 5.0, respectively.

In the course of the grain formation, the solutions were each added in a proper rate so that new nucleus was not formed and ostwald ripening was not proceeded. After completion of the addition, the emulsion was desalted and washed by an usual flocculation process at 40° C. and redispersed by adding gelatin, and the pAg and pH thereof were adjusted to 8.1 and 8.5, respectively.

Thus obtained emulsion is an emulsion comprising tabular grains having a grain diameter (the length of a side of a cube having the same volume) of 0.65 μm, an average aspect ratio of 7.2 and a halide composition shown in Table 7. The surface silver iodide content measured by the method described in this specification was 4.5 mole-%.

Sensitizing dyes SD-5, SD-6 and SD-7 were added to the above obtained Emulsion Em-1, and sodium thiosulfate, chloroauric acid, potassium thiocyanate, and a selenium sensitizer b-1 were added. Then the emulsion was chemically ripened so that the relation of fog and sensitivity was made optimum.

After completion of the chemical sensitization, a stabilizer ST-1 and a fog preventing agent AF-1 were added to the emulsion. The added amount of ST-1 was 1 g per mole of silver halide and that of AF-1 was 15 mg per mole of silver halide.

Thus chemically sensitized Em-A corresponding to Em-1 was prepared.

SD-5

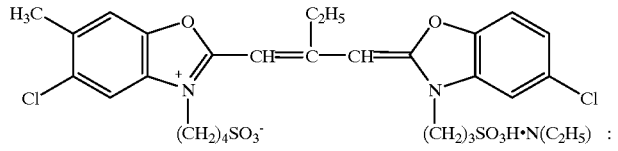

SD-6

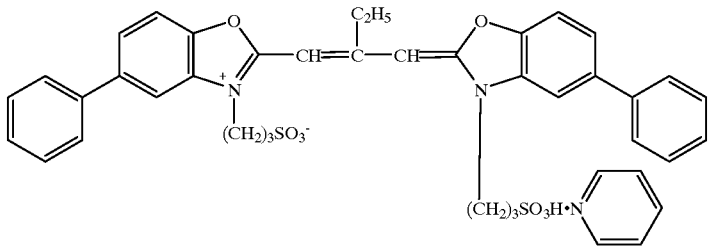

-continued

SD-7

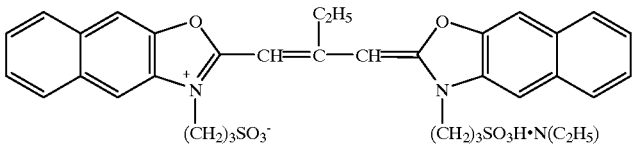

Selenium sensitizer b-1

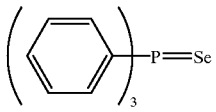

ST-1

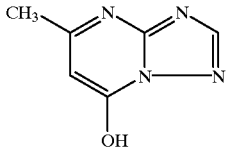

AF-1

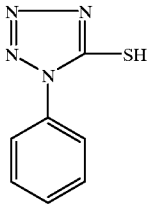

<Preparation of multi-layer color photographic material>

On a subbed triacetyl cellulose film support, the following layers were provided in the order from the support to prepare a multi-layer color photographic material Sample 101. Emulsion-A prepared in the above was used in the fifth, tenth and fifteenth layers.

The adding amount is grams per square meter except one with a specific description.

| | |
|---|---|
| **First layer: Antihalation layer** | |
| Yellow colloid silver | 0.16 |
| UV absorbent (UV-1) | 0.20 |
| High-boiling solvent (Oil-1) | 0.07 |
| Gelatin | 1.53 |
| **Second layer: Interlayer** | |
| Color stain preventing agent (SC-1) | 0.06 |
| High-boiling solvent (Oil-2) | 0.08 |
| Gelatin | 0.80 |
| **Third layer: Low speed red-sensitive layer** | |
| Silver iodobromide emulsion (average diameter: 0.38 μm, silver iodide content: 8.0 mole-%) | 0.45 |
| Silver iodobromide emulsion (average diameter: 0.27 μm, silver iodide content: 2.0 mole-%) | 0.18 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-4}$ |
| Sensitizing dye (SD-4) | $1.0 \times 10^{-4}$ |
| Cyan coupler (C-1) | 0.56 |
| Colored cyan coupler (CC-1) | 0.021 |
| DIR compound (D-1) | 0.025 |
| High-boiling organic solvent (Oil-1) | 0.49 |
| Gelatin | 1.14 |
| **Fourth layer: Medium speed red-sensitive layer** | |
| Silver iodobromide emulsion (average diameter: 0.52 μm, silver iodide content: 8.0 mole-%) | 0.89 |
| Silver iodobromide emulsion (average diameter: 0.38 μm, silver iodide content: 8.0 mole-%) | 0.22 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-4}$ |
| Cyan coupler (C-1) | 0.45 |
| Colored cyan coupler (CC-1) | 0.038 |
| DIR compound (D-1) | 0.017 |
| High-boiling organic solvent (Oil-1) | 0.39 |
| Gelatin | 1.01 |
| **Fifth layer: High speed red-sensitive layer** | |
| Emulsion-A | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-4}$ |
| Cyan coupler (C-2) | 0.20 |
| Colored cyan coupler (CC-1) | 0.034 |
| DIR compound (D-3) | 0.001 |
| High-boiling organic solvent (Oil-1) | 0.37 |
| Gelatin | 1.10 |
| **Sixth layer: Interlayer** | |
| Color stain preventing agent (SC-1) | 0.075 |
| High-boiling organic solvent (Oil-2) | 0.095 |
| Gelatin | 1.00 |
| **Seventh layer: Interlayer** | |
| Gelatin | 0.45 |
| **Eighth layer: Low speed green-sensitive layer** | |
| Silver iodobromide emulsion (average diameter: 0.38 μm, silver iodide content: 8.0 mole-%) | 0.68 |
| Silver iodobromide emulsion (average diameter: 0.27 μm, silver iodide content: 2.0 mole-%) | 0.18 |
| Sensitizing dye (SD-4) | $7.4 \times 10^{-4}$ |
| Sensitizing dye (SD-5) | $6.6 \times 10^{-4}$ |
| Magenta coupler (M-1) | 0.19 |

-continued

| | |
|---|---|
| Magenta coupler (M-2) | 0.49 |
| Colored Magenta coupler (CM-1) | 0.12 |
| High-boiling organic solvent (Oil-2) | 0.31 |
| Gelatin | 1.89 |
| **Ninth layer: Medium speed green-sensitive layer** | |
| Silver iodobromide emulsion (average diameter: 0.59 μm, silver iodide content: 8.0 mole-%) | 0.76 |
| Sensitizing dye (SD-6) | $1.5 \times 10^{-4}$ |
| Sensitizing dye (SD-7) | $1.6 \times 10^{-4}$ |
| Sensitizing dye (SD-8) | $1.5 \times 10^{-4}$ |
| Magenta coupler (M-1) | 0.043 |
| Magenta coupler (M-2) | 0.10 |
| Colored Magenta coupler (CM-2) | 0.039 |
| DIR compound (D-2) | 0.021 |
| DIR compound (D-3) | 0.002 |
| High-boiling organic solvent (Oil-2) | 0.17 |
| Gelatin | 0.76 |
| **Tenth layer: High speed green-sensitive layer** | |
| Emulsion-A | 1.46 |
| Magenta coupler (M-1) | 0.08 |
| Magenta coupler (M-2) | 0.133 |
| Colored Magenta coupler (CM-2) | 0.014 |
| High-boiling organic solvent (Oil-1) | 0.15 |
| High-boiling organic solvent (Oil-2) | 0.22 |
| Gelatin | 1.08 |
| **Eleventh layer: Yellow filter layer** | |
| Yellow colloid silver | 0.07 |
| Color stain preventing agent (SC-1) | 0.18 |
| Formalin scavenger (HS-1) | 0.14 |
| High-boiling organic solvent (Oil-2) | 0.11 |
| Gelatin | 0.73 |
| **Twelfth layer: Interlayer** | |
| Formalin scavenger (HS-1) | 0.18 |
| Gelatin | 0.60 |
| **Thirteenth layer: Low speed blue-sensitive layer** | |
| Silver iodobromide emulsion (average diameter: 0.59 μm, silver iodide content: 8.0 mole-%) | 0.075 |
| Silver iodobromide emulsion (average diameter: 0.38 μm, silver iodide content: 3.0 mole-%) | 0.15 |
| Silver iodobromide emulsion (average diameter: 0.27 μm, silver iodide content: 2.0 mole-%) | 0.20 |
| Sensitizing dye (SD-9) | $2.1 \times 10^{-4}$ |
| Sensitizing dye (SD-10) | $2.8 \times 10^{-4}$ |
| Yellow coupler (Y-1) | 0.89 |
| DIR compound (D-4) | 0.008 |
| High-boiling organic solvent (Oil-2) | 0.27 |
| Gelatin | 1.51 |
| **Fourteenth layer: High speed blue-sensitive layer** | |
| Emulsion-A | 0.95 |
| Sensitizing dye (SD-9) | $7.3 \times 10^{-4}$ |
| Sensitizing dye (SD-10) | $2.8 \times 10^{-4}$ |
| Yellow coupler (Y-1) | 0.16 |
| High-boiling organic solvent (Oil-2) | 0.093 |
| Gelatin | 0.80 |
| **Fifteenth layer: First protective layer** | |
| Silver iodobromide emulsion (average diameter: 0.05 μm, silver iodide content: 3.0 mole-%) | 0.30 |
| UV absorbent (UV-1) | 0.094 |
| UV absorbent (UV-2) | 0.10 |
| Formalin scavenger (SH-1) | 0.38 |
| High-boiling organic solvent (Oil-1) | 0.05 |
| Gelatin | 1.44 |
| **Sixteenth layer: Second protective layer** | |
| Alkali-soluble matting agent (PM-1) (average particle diameter; 2 μm) | 0.15 |
| Poly(methyl methacrylate (average particle diameter; 3 μm) | 0.04 |
| Lubricant (WAX-1) | 0.02 |
| Gelatin | 0.55 |

Moreover, coating aids DU-1, SU-2 and SU-3, a dispersing aid SU-4, a viscosity controlling agent V-1, a stabilizer ST-1, dyes AI-1 and AI-2, a fog preventing agent AF-1, two kinds of polyvinylpyrrolydone (AF-2) each having a weight average molecular weight of 10,000 and 100,000, respectively, hardening agents H-1 and H-2 and a preservative DI-1 were added other than the above-mentioned components. Adding amount of DI-1 was 9.4 mg/m$^2$.

Structures of the compounds used in the sample are shown below.

C-1

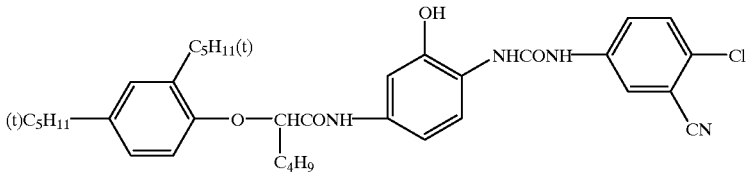

C-2

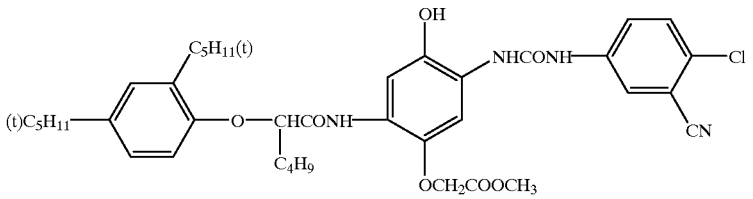

-continued
M-1
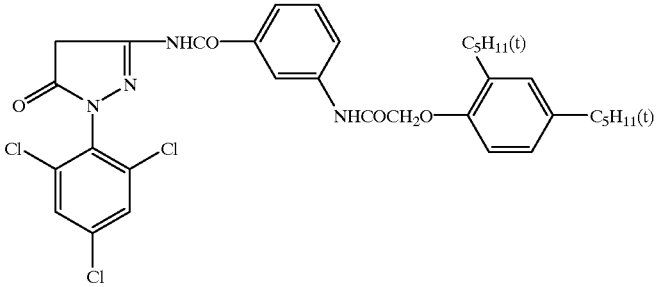
M-2
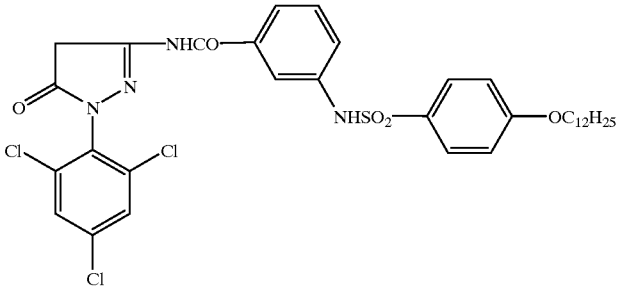
Y-1
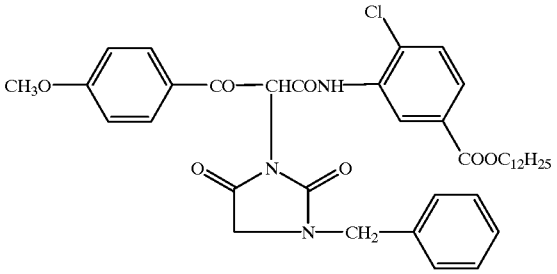
CC-1
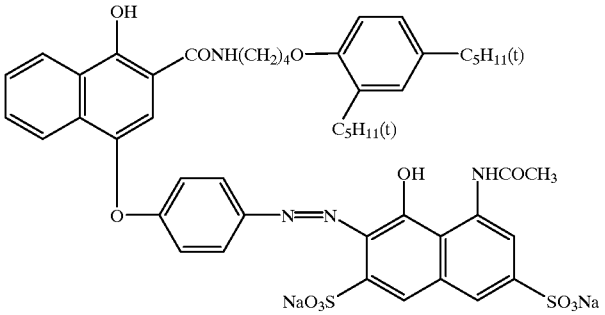
CM-1
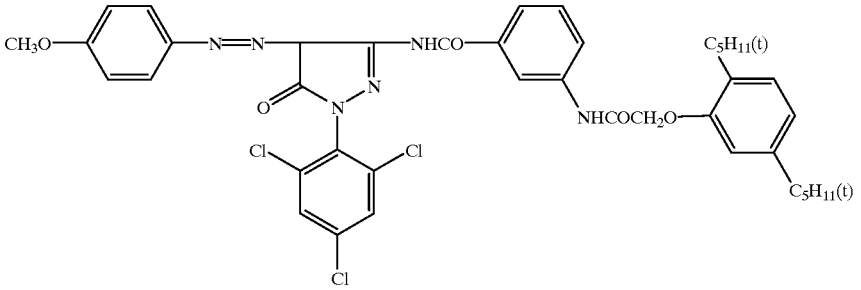

-continued
CM-2
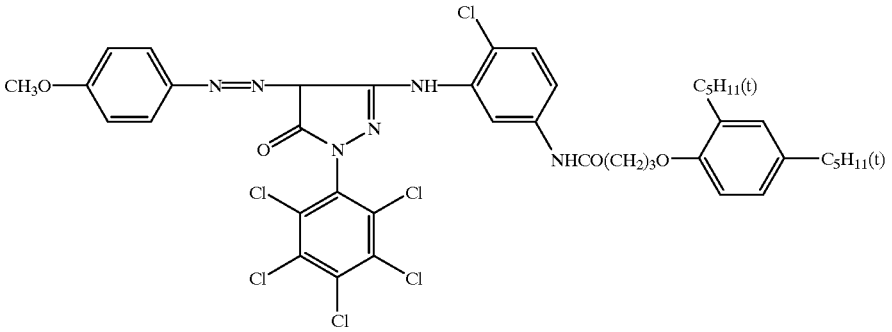
D-1
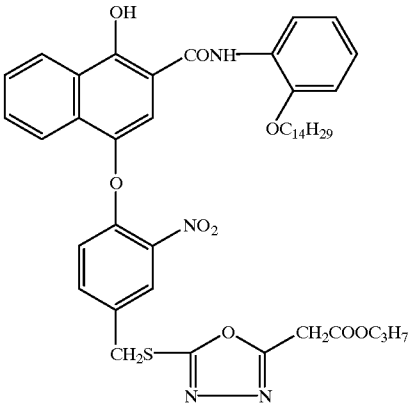
D-2
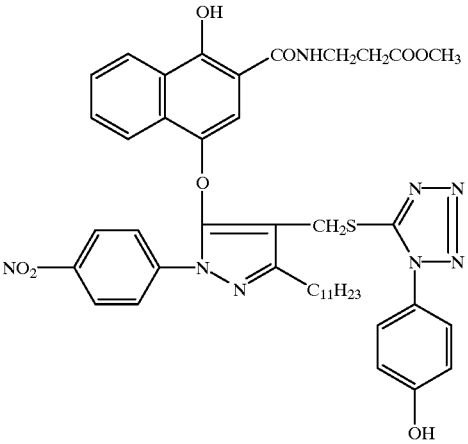

-continued
D-3
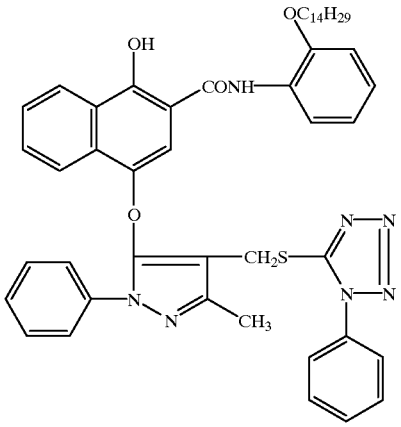
D-4
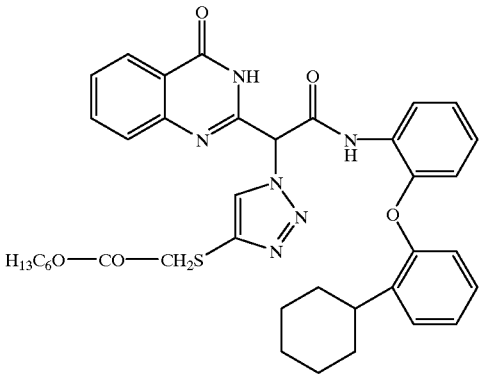
Oil-1
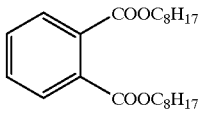
Oil-2
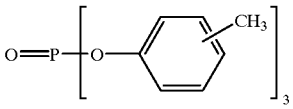
SC-1
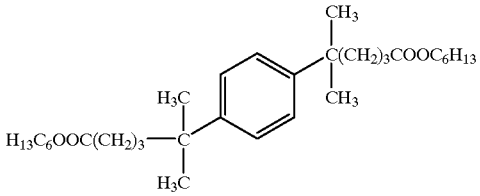
UV-1
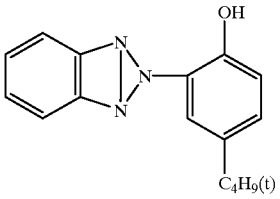

-continued
UV-2
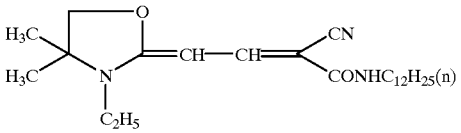
WAX-1
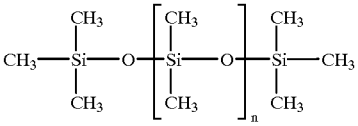
Weight average molecular weight MW: 3,000
SU-1
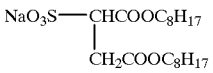
SU-2
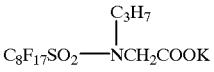
SU-3
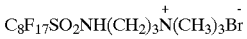
SU-4
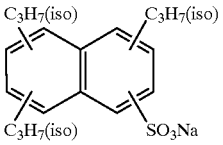
HS-1
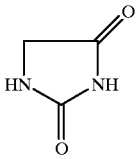
H-1
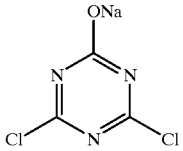
H-2
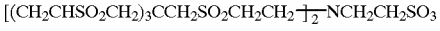
PM-1
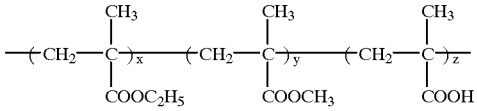

-continued
V-1
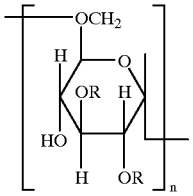
R: H, $SO_3H$
Average molecular weight Mw: 120,000
SD-1
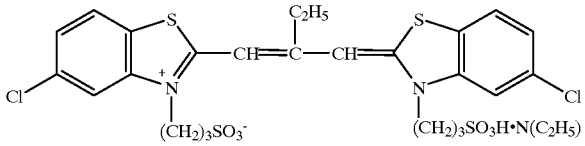
SD-2
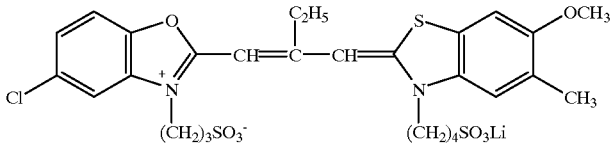
SD-3
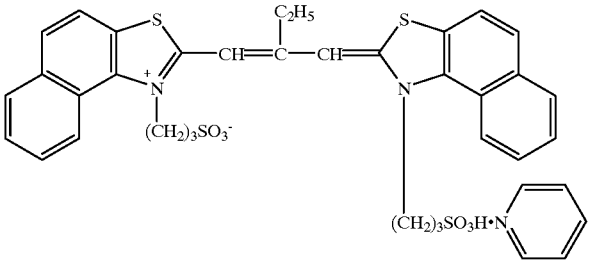
SD-4
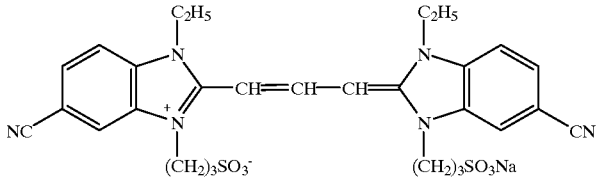
SD-5
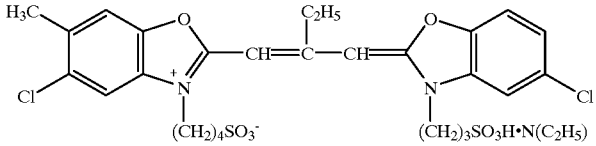
SD-6
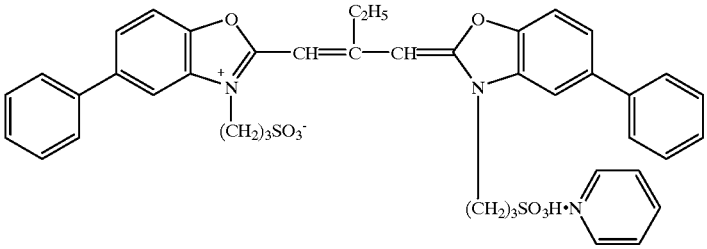

-continued
SD-7
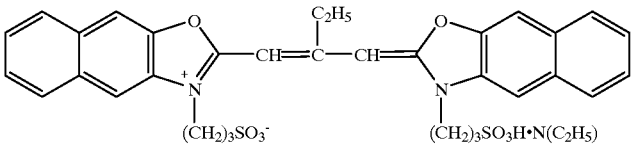
SD-8
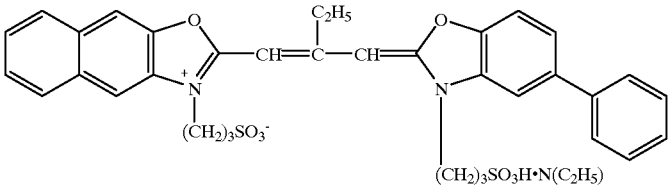
SD-9
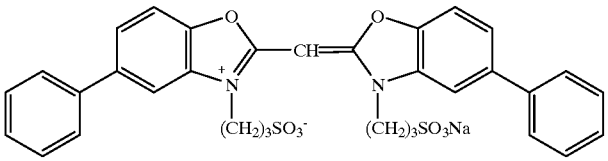
SD-10
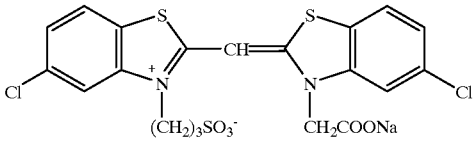
ST-1
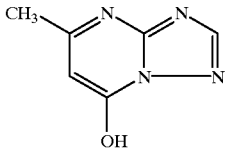
AF-1
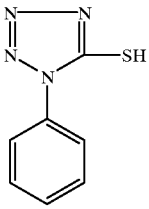
AF-2
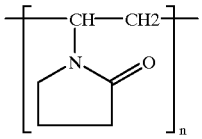
n: Polymerization degree
Dl-1
(Mixture of the following three components)
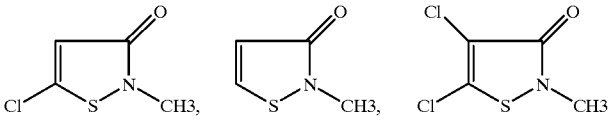
(Component A) (Component B) (Component C)
A:B:C = 50:46:4 (mole ratio)

-continued

Al-1

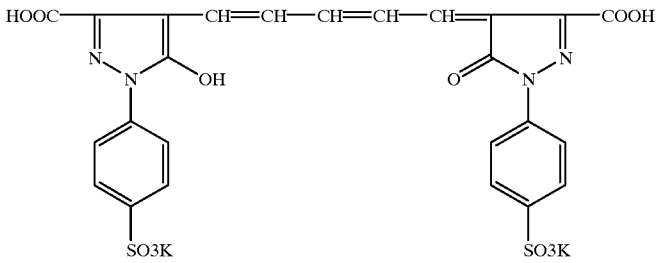

Al-2

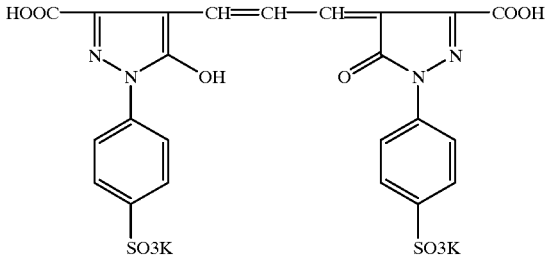

(Automatic processor)

A color negative processor CL-KP-50QA, manufactured by Konica Corp., was used. The fixing tank was modified so that the surface of the light-sensitive material is not exposed to the current of the circulating by using the jet stirring system.

(Treatment processes)

| | Processing time | Processing temperature | Replenishing amount |
|---|---|---|---|
| Color developing | 3 min. 15 sec. | 38.5° C. | 520 ml/m$^2$ |
| Bleaching | 45 sec. | 38° C. | 100 ml/m$^2$ |
| Fixing-1 | 45 sec. | 38° C. | |
| Fixing-2 | 45 sec. | 38° C. | 550 ml/m$^2$ |
| Stabilizing-1 | 20 sec. | 38° C. | |
| Stabilizing-2 | 20 sec. | 38° C. | |
| Stabilizing-3 | 20 sec. | 38° C. | 860 ml/m$^2$ |
| Drying | 90 sec. | 65° C. | |

(Receipt of processing solutions)
Color developing solution: per 1 liter

| | Using solution | Replenisher |
|---|---|---|
| Sodium sulfite | 5.0 g | 8.0 g |
| Sodium carbonate | 45.0 g | 45.0 g |
| Pentasodium diethylenetriamine-pentaacetate | 4.0 g | 4.0 g |
| Hydroxylamine sulfate | 3.0 g | 5.0 g |
| Potassium bromide | 1.5 g | 0.3 g |
| 2-methylbenzimidazole | 0.1 g | 0.15 g |
| Polyvinylpyrrolidone (K-17) | 2.0 g | 2.0 g |
| Potassium iodide | 2.0 mg | — |
| 4-amino-3-methyl-N-ethyl-(β-hydroxyethyl)aniline sulfate | 4.5 g | 11.5 g |
| pH | 10.10 | 10.65 |

Each of the solutions was made-up to 1 liter by water, and the pH was adjusted by potassium hydroxide or 50% sulfuric acid.

Bleaching solution: per 1 liter

| | Using solution | Replenisher |
|---|---|---|
| Ammonium ferric 1,3-propylenediaminetetra-acetate | 133 g | 190 g |
| 1,3-propylenediaminetetraacetic acid | 5 g | 7 g |
| Ammonium bromide | 60 g | 90 g |
| Maleic acid | 40 g | 60 g |
| Imidazole | 10 g | 15 g |
| pH | 3.0 | 2.5 |

Each of the solutions was made-up to 1 liter by water, and the pH was adjusted by potassium hydroxide or 50% sulfuric acid.

Fixing solution: per 1 liter

Using solution and replenisher are the same with each other.

| | |
|---|---|
| Ammonium thiosulfate | 100 g |
| Sodium thiosulfate | 10 g |
| Sodium sulfite | 12 g |
| Disodium ethylenediaminetetraacetate | 2 g |
| Compound shown in Table 1 | 0.01 moles |
| pH | 7.5 |

Each of the solutions was made-up to 1 liter by water, and the pH was adjusted by aqueous ammonia or 50% sulfuric acid.

Stabilizing solution: per 1 liter

Using solution and replenisher are the same with each other.

| | |
|---|---|
| m-hydroxybenzaldehyde | 1.5 g |
| Disodium ethylenediaminetetraacetate | 0.6 g |
| β-cyclodextrin | 0.2 g |
| Potassium carbonate | 0.2 g |
| pH | 8.0 |

Each of the solutions was made-up to 1 liter by water, and the pH was adjusted by potassium hydroxide or 50% sulfuric acid.

Each of the solutions were charged to the automatic processor, and Color Negative Film LV400, manufactured by Konica Corp., was processed until the replenishing amount to the fixing tank was become 3 times of the volume of the fixing tank (10 liters) to bring the processing solution into the converged state. A scene was photographed by the above-prepared of multi-layer color photographic material Sample 101 with under-, normal- and over-exposure conditions. The sample was processed by the above-prepared converged processing solutions. Besides, a negative of Sample No.1 was refixed after the processing by the fixing solution for 90 seconds at 38° C., washed for 3 minutes and dried to prepare a standard negative (completely desilvered negative). The level of the negative channel of a printer processor of NPS-858-J-A system, manufactured by Konica Corp., was set using the standard negative. Namely, a print having the same quality as a print printed through the standard negative can be obtained from a negative proceed by the same level processing as the standard negative. Prints were prepared from the light-sensitive materials each processed by each of the converged processing solution, respectively, using the such set channel. When the printed level of the print was not equal, the level was compensated. The compensated YMC density was shown in Table 1. It is considered that the level compensation within 10% is not problem in practical use.

The remaining silver amount and the transmission density at 650 nm were also measured.

Moreover, the processed light-sensitive materials were each refixed, rewashed and redried in the same manner as in the standard negative, and the difference of RMS granularity measure before and after the retreatment (ΔRMS) was determined. The RSM granularity was measured by scanning the density of the portion to be measured by a micro densitometer having a scanning open area of 750 $\mu m^2$ (slit width of 10 $\mu$m and slit length of 75 $\mu$m). A value of 1000 times of standard deviation of the variation of density at 1000 or more sampling points was determined and the value was expressed by a relative value when the value of Sample No. 1 was set at 1.00. A smaller value of ΔRMS corresponds to better property.

Thus obtained results are shown in Table 1.

TABLE 1

| Sample No. | Additive in fixing solution | Remaining amount of silver mg/m$^2$ (A) | Light absorbance at 650 nm (B) | B/A × $10^{-3}$ | Print compensation (%) Y | M | C | ΔRMS | Note |
|---|---|---|---|---|---|---|---|---|---|
| 1 | — | 209 | 0.85 | 4.07 | −10 | −10 | −40 | 1.00 | Comp. |
| 2 | — | 506 | 0.98 | 1.94 | −10 | −15 | −40 | 1.20 | Comp. |
| 3 | — | 110 | 0.50 | 5.45 | −10 | −10 | −30 | 0.94 | Comp. |
| 4 | I-1 | 650 | 0.50 | 0.77 | −5 | −0 | −10 | 0.64 | Inv. |
| 5 | I-2 | 625 | 0.44 | 0.70 | −5 | −5 | −10 | 0.66 | Inv. |
| 6 | I-9 | 667 | 0.43 | 0.64 | 0 | −5 | −10 | 0.59 | Inv. |
| 7 | I-10 | 700 | 0.35 | 0.50 | 0 | 0 | −5 | 0.45 | Inv. |
| 8 | I-13 | 790 | 0.36 | 0.46 | 0 | −5 | −5 | 0.53 | Inv. |
| 9 | I-22 | 702 | 0.39 | 0.56 | 0 | 0 | −10 | 0.47 | Inv. |
| 10 | I-23 | 773 | 0.46 | 0.60 | −5 | −5 | −10 | 0.46 | Inv. |
| 11 | I-10* I-23* | 704 | 0.45 | 0.64 | 0 | 0 | −5 | 0.45 | Inv. |

*Compounds I-10 and I-23 were each added 0.005 moles, respectively.

Regarding Sample Nos. 1 to 3, the circulation amount in the fixing tank of the automatic processor was varied to control the remaining amount of silver in the light-sensitive material (Sample 1: 3 l/min., Sample 2: 5 l/min. and Sample 3: 6 l/min.). The other samples were all fixed at 3 l/minutes.

As is shown in the results in Table 1, the light-sensitive materials having the relation between the remaining amount of silver and the transmission absorbance at 650 nm is within the range of the invention (the constitution of the invention described in claims 1 and 7) each give a certain quality of print, and there is no problem in the levels of granularity compared with that of the standard negative. As above-mentioned, the light-sensitive material can be prepared by the invention (the constitution of the invention described in claims 1 and 7) which gives a satisfactory print quality even when the silver is not completely removed.

Example 2

Prints were prepared while compensating the printing condition in the same manner as in Sample Nos. 1 and 7 of Example 1 except that the replenishing amount of the fixing solution was changed as shown in Table 2 in the course of preparation of the converged processing solutions. ΔRMS of each of the samples was measured and described in a relative value when that of comparative sample No. 1-1-1 was set at 1.00. Thus obtained results are shown in Table 2.

TABLE 2

| Sample No. | Replenishing amount ml/m$^2$ | Remaining silver amount mg/m$^2$ (A) | Light absorbance at 650 nm (B) | B/A × $10^{-3}$ | Print compensation (%) Y | M | C | ΔRMS |
|---|---|---|---|---|---|---|---|---|
| 1-1-1 | 1000 | 60 | 0.43 | 4.07 | −10 | −10 | −40 | 1.00 |
| 1-1-2 | 900 | 147 | 0.67 | 4.56 | −10 | −10 | −30 | 1.25 |
| 1-1-3 | 700 | 179 | 0.77 | 4.30 | −10 | −15 | −40 | 1.35 |
| 1-1-4 | 450 | 226 | 0.89 | 3.94 | −10 | −25 | −40 | 1.47 |
| 1-1-5 | 150 | 405 | 1.03 | 2.54 | −10 | −25 | −45 | 1.48 |
| 1-1-6 | 100 | 619 | 1.19 | 1.92 | −10 | −25 | −50 | 1.52 |
| 1-7-1 | 1000 | 329 | 0.30 | 0.91 | 0 | 0 | −5 | 0.59 |
| 1-7-2 | 900 | 538 | 0.35 | 0.65 | 0 | 0 | −5 | 0.64 |
| 1-7-3 | 700 | 754 | 0.34 | 0.45 | 0 | 0 | −5 | 0.66 |
| 1-7-4 | 450 | 990 | 0.36 | 0.36 | 0 | −5 | −5 | 0.67 |
| 1-7-5 | 150 | 1146 | 0.39 | 0.34 | 0 | −5 | −10 | 0.71 |
| 1-7-6 | 100 | 2067 | 0.77 | 0.37 | −5 | −10 | −10 | 0.88 |
| 1-7-7 | 80 | 3400 | 0.99 | 0.28 | −5 | −10 | −20 | 1.60 |

As shown in Table 2, the effects of the invention are enhanced when the replenishing amount is not more than 900 ml/m$^2$ (the constitution of the invention described in claim 5).

Example 3

Experiments the same as in Example 1 were performed to evaluate the print level compensation in the same manner as in Example 1 except that additives were added in the concentration described in Table 3 and a flow-stirring device was attached to the fixing tank. Print level of each sample was measured after storing in a condition at 65° C., 80% RH for 7 days.

Results are listed in Table 3.

Regarding the print compensation, C density is only described. Samples wedgewise exposed and processed by the above-mentioned processing were prepared and the maximum red density of each of them was measured. In the table, N1, N2, N3 and N4 are each the developing solution, bleaching solution, fixing solution and stabilizing solution, respectively. The adding amount of the compound is shown in a parenthesis blow the name of the compound.

Thus obtained results are listed in Table 3.

TABLE 3

| Experiment No. | N1 (Mol/l) | N2 (Mol/l) | N3 (Mol/l) | N4 (Mol/l) | Remaining silver amount mg/m$^2$ (A) | Light absorbance at 650 nm (B) | B/A × $10^{-3}$ | Print compensation (%) | Print compensation after storage (%) | $D_{max}$ (R) | Note |
|---|---|---|---|---|---|---|---|---|---|---|---|
| 3-1 | None | None | None | None | 244 | 0.82 | 3.36 | −35 | −55 | 2.12 | Comp. |
| 3-2 | I-10 (0.001) | None | None | None | 399 | 0.41 | 1.03 | −10 | −15 | 1.93 | Inv. |
| 3-3 | None | I-10 (0.02) | None | None | 427 | 0.38 | 0.89 | −10 | −10 | 2.09 | Inv. |
| 3-4 | None | None | I-10 (0.01) | None | 721 | 0.36 | 0.50 | −5 | −5 | 2.08 | Inv. |
| 3-5 | None | None | None | I-10 (0.002) | 509 | 0.44 | 0.86 | −5 | −10 | 2.10 | Inv. |
| 3-6 | None | None | I-10 (0.01) | I-10 (0.002) | 733 | 0.39 | 0.53 | −5 | −5 | 2.11 | Inv. |
| 3-7 | None | I-10 (0.02) | None | I-10 (0.002) | 627 | 0.40 | 0.64 | −5 | −5 | 2.08 | Inv. |
| 3-8 | None | I-10 (0.02) | I-10 (0.01) | None | 778 | 0.34 | 0.44 | −5 | −5 | 2.12 | Inv. |
| 3-9 | None | I-10 (0.02) | I-10 (0.01) | I-10 (0.002) | 801 | 0.33 | 0.41 | −5 | −5 | 2.10 | Inv. |

As is shown in Table 3, the effects of the invention are clearly enhanced when the compound of the invention is added into the processing solution having a bleaching ability, the processing solution having a fixing ability or the stabilizing solution (the constitution of the invention described in claim 2 and 3).

Example 4

Experiments were performed in the same manner as in Sample 3-3 of Example 3 except that the concentration of the additive to be added to the bleaching solution was changed as shown Table 4 and the replenishing amount of the bleaching solution was changed to 90 ml/m$^2$, and the print condition was compensated (density of Y, M and C). Moreover, the formation of a line-shaped unevenness on the unexposed negative and on a print having a density of 0.8 printed through the negative were visually evaluated. The evaluated results were classified in the following four ranks.

4: No line is observed on both of the negative and the print

3: The line is slightly observed on the negative but does not cause any problem on the print.

2: The line is confirmed on the negative and slightly observed on the print.

1: The line is clearly confirmed on both of the negative and the print

Thus obtained results are shown in Table 4.

TABLE 4

| Experiment No. | Added amount of I-10 (Mole/l) | Remaining silver amount mg/m$^2$ (A) | Light absorbance at 650 nm (B) | B/A × $10^{-3}$ | Print compensation (%) Y | M | C | Line-shaped unevenness | Note |
|---|---|---|---|---|---|---|---|---|---|
| 4-1 | 0.0 | 302 | 0.82 | 2.71 | −5 | −5 | −40 | 1 | Comp. |
| 4-2 | 0.0001 | 369 | 0.52 | 1.41 | 0 | −5 | −10 | 3 | Inv. |
| 4-3 | 0.005 | 407 | 0.47 | 1.15 | 0 | 0 | −10 | 3 | Inv. |
| 4-4 | 0.01 | 435 | 0.43 | 0.99 | 0 | 0 | −5 | 4 | Inv. |
| 4-5 | 0.03 | 499 | 0.39 | 0.78 | 0 | 0 | −5 | 4 | Inv. |
| 4-6 | 0.05 | 597 | 0.40 | 0.67 | 0 | 0 | −5 | 4 | Inv. |
| 4-7 | 0.07 | 718 | 0.44 | 0.61 | 0 | 0 | −10 | 3 | Inv. |
| 4-8 | 0.1 | 803 | 0.49 | 0.61 | 0 | −5 | −10 | 3 | Inv. |
| 4-9 | 0.15 | 1012 | 0.54 | 0.53 | −5 | −5 | −10 | 3 | Inv. |

As is shown in Table 4, the adding amount of the compound of the invention is preferably within the range of from 0.0001 moles/l to 0.1 moles/l (the constitution of the invention described in claim 4), more preferably within the range of from 0.005 moles/l to 0.07 moles/l, and most preferably within the range of from 0.01 moles/l to 0.05 moles/l from the viewpoints of the print compensation and the formation of the line-shaped unevenness.

Example 5

Experiments were performed in the same manner as in Sample 3-4 of Example 3 except that the concentration of the additive to be added to the fixing solution was changed as shown in Table 5 and the replenishing amount of the fixing solution was changed to 450 ml/m$^2$, and the print condition was compensated (density of Y, M and C). Moreover, the formation of a line-shaped unevenness on the unexposed negative was evaluated in the same manner.

Results are listed in Table 5.

TABLE 5

| Experiment No. | Added amount of I-10 (Mole/l) | Remaining silver amount mg/m$^2$ (A) | Light absorbance at 650 nm (B) | B/A × $10^{-3}$ | Print compensation (%) Y | M | C | Line-shaped unevenness | Note |
|---|---|---|---|---|---|---|---|---|---|
| 5-1 | 0.0 | 261 | 0.86 | 3.30 | −5 | −10 | −40 | 1 | Comp. |
| 5-2 | 0.0001 | 391 | 0.55 | 1.41 | 0 | −5 | −10 | 3 | Inv. |
| 5-3 | 0.001 | 554 | 0.45 | 0.90 | 0 | 0 | −10 | 3 | Inv. |
| 5-4 | 0.005 | 725 | 0.38 | 0.52 | 0 | 0 | −5 | 4 | Inv. |
| 5-5 | 0.01 | 899 | 0.39 | 0.43 | 0 | 0 | −5 | 4 | Inv. |
| 5-6 | 0.03 | 945 | 0.42 | 0.44 | 0 | 0 | −5 | 4 | Inv. |
| 5-7 | 0.05 | 967 | 0.47 | 0.49 | 0 | 0 | −10 | 3 | Inv. |
| 5-8 | 0.1 | 996 | 0.52 | 0.52 | 0 | −5 | −10 | 3 | Inv. |
| 5-9 | 0.15 | 1035 | 0.60 | 0.58 | −5 | −10 | −10 | 3 | Inv. |

As is shown in Table 5, the adding amount of the compound of the invention is preferably within the range of from 0.0001 moles/l to 0.1 moles/l (the constitution of the invention described in claim 4), more preferably within the range of from 0.001 moles/l to 0.05 moles/l, and most preferably within the range of from 0.005 moles/l to 0.03 moles/l from the viewpoints of the print compensation and the formation of the line-shaped unevenness.

Example 6

Experiments were performed in the same manner as in Sample 3-5 of Example 3 except that the concentration of the additive to be added to the stabilizing solution was changed as shown in Table 6 and the replenishing amount of the stabilizing solution was changed to 800 ml/m$^2$, and the print condition was compensated (density of Y, M and C). Moreover, the formation of a line-shaped unevenness on the unexposed negative was evaluated in the same manner.

Results are listed in Table 6

TABLE 6

| Experiment | Added amount of I-10 | Remaining silver amount | Light absorbance at 650 nm | | Print compensation (%) | | | Line-shaped | |
|---|---|---|---|---|---|---|---|---|---|
| No. | (Mole/l) | (mg/m$^2$)(A) | (B) | B/A × $10^{-3}$ | Y | M | C | unevenness | Note |
| 6-1 | 0.0 | 299 | 0.80 | 3.30 | −5 | −10 | −35 | 1 | Comp. |
| 6-2 | 0.0001 | 379 | 0.55 | 1.41 | 0 | −5 | −10 | 3 | Inv. |
| 6-3 | 0.0005 | 466 | 0.44 | 0.90 | 0 | 0 | −10 | 3 | Inv. |
| 6-4 | 0.001 | 531 | 0.42 | 0.52 | 0 | 0 | −10 | 4 | Inv. |
| 6-5 | 0.002 | 640 | 0.43 | 0.43 | 0 | 0 | −5 | 4 | Inv. |
| 6-6 | 0.01 | 724 | 0.44 | 0.44 | 0 | 0 | −10 | 4 | Inv. |
| 6-7 | 0.03 | 836 | 0.47 | 0.49 | 0 | 0 | −10 | 3 | Inv. |
| 6-8 | 0.1 | 911 | 0.54 | 0.52 | 0 | −10 | −10 | 3 | Inv. |
| 6-9 | 0.15 | 1005 | 0.59 | 0.58 | −5 | −10 | −10 | 3 | Inv. |

As is shown in Table 6, the adding amount of the compound of the invention is preferably within the range of from 0.0001 moles/l to 0.1 moles/l (the constitution of the invention described in claim 4), more preferably within the range of from 0.005 moles/l to 0.03 moles/l, and most preferably within the range of from 0.001 moles/l to 0.01 moles/l from the viewpoints of the print compensation and the formation of the line-shaped unevenness.

Example 7

Emulsions Em-2 to Em-6 to be used in place of Em-1 were prepared in the following manner.

Preparation of emulsion Em-2

Emulsion Em-2 was prepared in the same manner as in Em-1 except that 0.004 moles of SMC-1 was added after completion of the process 2) and the emulsion was ripened for 16 minutes.

Thus obtained emulsion was an emulsion comprising tabular grains having a grain diameter (the length of the side of a cube having a volume the same as the grain) of 0.65 $\mu$m, an average aspect ratio of 7.0 and a halide composition shown in Table 7. The surface silver iodide content was 12.5 mole-%.

Preparation of emulsion Em-3.

Seven hundreds milliliters of an aqueous solution containing Seed Crystal Emulsion-1 in an amount corresponding to 0.178 moles, 0.5 ml of 10% methanol solution of $HO(CH_2CH_2O)_m(CH(CH_3)CH_2O)_{19.8}(CH_2CH_2O)_nH$ (m+n=9.77) and 4.5% by weight of inactive gelatin was maintained at 75° C. and the pAg and pH are adjusted to 8.9 and 5.0, respectively. Grains were formed by the following procedure using a double-jet method while vigorously stirring the solution.

1) To the solution, 2.1 moles of aqueous solution of silver nitrate, 0.195 moles of SMC-1 and an aqueous solution of potassium bromide were added while the pAg and pH was maintained at 8.9 and 5.0, respectively.

2) The temperature of the solution was lowered to 60° C. and pAg of the solution was adjusted to 9.8. Then the solution was ripened for 2 minutes after addition of 0.071 moles of SMC-1 (for introducing a dislocation line).

3) Thereafter, 0.959 moles of aqueous solution of silver nitrate, 0.030 moles of SMC-1 and an aqueous solution of potassium bromide were added while the pAg and pH was maintained at 8.9 and 5.0, respectively.

In the course of the grain formation, the solutions were each added in a proper rate so that new nucleus was not formed and ostwald ripening was not proceeded. After completion of the addition, the emulsion was desalted and washed by an usual flocculation process at 40° C. and redispersed by adding gelatin, and the pAg and pH thereof were adjusted to 8.1 and 8.5, respectively.

Thus obtained emulsion was an emulsion comprising tabular grains having a grain diameter (the length of the side of a cube having a volume the same as the grain) of 0.65 $\mu$m, an average aspect ratio of 7.2 and a halide composition shown in Table 7. It was observed by electron microscopic observation that grains accounting for 60% or more of the total projection area of grains contained in the emulsion each has 5 or more dislocation lines are existed in both of the fringe portion and the interior portion of the grain. The surface silver iodide content was 6.3 mole-%.

Preparation of emulsion Em-4

Emulsion Em-4 was prepared in the same manner as in Em-3 except that the amounts of silver nitrate and SMC to be added in process 2) were changed to 0.91 moles and 0.069 moles, respectively.

Thus obtained emulsion was an emulsion comprising tabular grains having a grain diameter (the length of the side of a cube having a volume the same as the grain) of 0.65 μm. an average aspect ratio of 6.5 and a halide composition shown in Table 7. It was observed by electron microscopic observation that grains accounting for 60% or more of the total projection area of grains contained in the emulsion each has 5 or more dislocation lines are :existed in both of the fringe portion and the interior portion of the grain. The surface silver iodide content was 11.5 mole-%.

Preparation of emulsion Em-5

Seven hundreds milliliters of an aqueous solution containing Seed Crystal Emulsion-1 in an amount corresponding to 0.178 moles, 0.5 ml of 10% methanol solution of sodium salt of isopprene-polyethyleneoxy-disuccinic acid ester and 4.5% by weight of inactive gelatin was maintained at 75° C. and the pAg and pH are adjusted to 8.9 and 5.0, respectively. Grains were formed by the following procedure using a double-jet method while vigorously stirring the solution.

1) To the solution, 0.692 moles of aqueous solution of silver nitrate, 0.297 moles of SMC-1 and an aqueous solution of potassium bromide were added while the pAg and pH was maintained at 8.9 and 5.0, respectively.

2) Then 2.295 moles of aqueous solution of silver nitrate, 0.071 moles of SMC-1 and an aqueous solution of potassium bromide were added while the pAg and pH was maintained at 8.9 and 5.0, respectively.

3) After completion of process 2), the emulsion was ripened for 15 minutes after addition of 0.004 moles of SMC-1.

In the course of the grain formation, the solutions were each added in a proper rate so that new nucleus was not formed and Ostwald ripening was not proceeded. After completion process 2), the emulsion was desalted and washed by an usual flocculation process at 40° C. and redispersed by adding gelatin, and the pAg and pH thereof were adjusted to 8.1 and 6.0, respectively.

Thus obtained emulsion was an emulsion comprising tabular grains having a grain diameter (the length of the side of a cube having a volume the same as the grain) of 0.65 μm, an average aspect ratio of 4.1 and a halide composition shown in Table 7. According to electron microscopic observation, any grain having a dislocation line was not found. The surface silver iodide content was 11. 7 mole-%.

Preparation of emulsion Em-6

A comparative emulsion Em-6 was prepared according to the preparation method described in Example 4 of JP O.P.I. 7-92594.

The contents of the above-prepared emulsions Em-2 to Em-6 and that of Fm-1 are shown in Table 7.

TABLE 7

| Em. No. | AgI composition[1)] | Aspect ratio[2)] | Dislocation line | Surface AgI content |
|---|---|---|---|---|
| Em-1 | 2/8.5/3 | 7.2 | None | 4.5 |
| Em-2 | 2/8.5/3 | 7.0 | None | 12.5 |
| Em-3 | 2/8.5/X/3 | 7.2 | Presence | 6.3 |
| Em-4 | 2/7.6/X/7 | 6.5 | Presence | 11.5 |
| Em-5 | 2/30/3 | 4.1 | None | 11.7 |
| Em-6 | 6/→/30/→/0[3)] | 2.0 | None | 2.1 |

[1)]Silver iodide content in each of the phases. X is the potion at which the location lines are introduced.
[2)]The aspect ratio of the grains accounting for 50% of the total projection area of silver halide grains contained in the emulsion.
[3)]"→" shows that the iodide content was continuously changed according to the receipt.

Sensitizing dyes SD-5, SD-6 and SD-7, sodium thiosulfate, chloroauric acid, potassium thiocyanate, and a selenium sensitizer b-1 were added to each of Em-2 to Em-6. Then the emulsion was were each chemically ripened so that the relation of fog and sensitivity was made optimum.

Stabilizer ST-1 and fog preventing agent AF-1 were added to each of the chemically sensitized emulsions. The adding amount of ST-1 was 1 g/mole of silver halide and that of AF-1 was 15 mg/mole of silver halide.

Chemically sensitized emulsions Em-B through Em-F each corresponding to emulsion Em-2 through Em-6, respectively, fourteenth layers of Sample 101.

The above-prepared samples were processed in the same manner as in Example 1 using the fixing solution used for Sample No. 7 except that the temperature of the fixing solution was changed to 35° C. After processing the printing properties of thus obtained negatives were evaluated. ΔRMS was also measured and shown as the relative value when the value of comparative sample 7-1 was set at 1.00.

Results are shown in Table 8

TABLE 8

| Experiment No. | Sample | Remaining silver amount mg/m$^2$ (A) | Light absorbance at 650 nm (B) | Print B/A × $10^{-3}$ | compensation (%) Y | M | C | ΔRMS |
|---|---|---|---|---|---|---|---|---|
| 7-1 | 101 | 790 | 0.45 | 0.57 | 0 | −5 | −10 | 1.00 |
| 7-2 | 102 | 828 | 0.42 | 0.51 | 0 | −5 | −5 | 0.93 |
| 7-3 | 103 | 799 | 0.40 | 0.50 | 0 | 0 | −5 | 0.88 |
| 7-4 | 104 | 836 | 0.40 | 0.48 | 0 | 0 | −5 | 0.83 |
| 7-5 | 105 | 829 | 0.43 | 0.52 | 0 | −5 | −5 | 0.95 |
| 7-6 | 106 | 840 | 0.48 | 0.59 | 0 | −5 | −10 | 0.92 |

It is clear from the results in Table 8 that the effects of the invention are enhanced when the silver halide photographic light-sensitive material has at least one layer comprising a silver halide emulsion in which tabular silver halide grains having an aspect ratio not less than 5.0 and a thickness of from 0.1 μm to 0.3 μm account for not less than 50% of the total projection area, and not less than 50% of such the tabular grains have the maximum silver iodide content of less than 15 mole-% in the phase other than the outermost layer, a silver iodide content of not less than 6 mole-% in the outermost layer, and 5 or more dislocation lines per grain.

Example 8

A light-sensitive material was prepared in the same manner as in Sample 101 of Example 1 except that the amounts of high-boiling organic solvents Oil-1 and Oil-2 were increased in the same proportion so that the ratio of the total weigh of oleophilic photographic components/weight of gelatin (O/G ratio) is become as shown in Table 9, and the total coated amount of gelatin was become as shown in Table 9. Then the light-sensitive materials was processed in the same manner as in Example 1 except that the fixing solution used for processing Sample 7-1 was used and the circulating amount of the fixing solution was changed to 3 l/min. The printing properties of the negatives obtained by processing the samples were evaluated. ΔRMS was also measured and shown as the relative value when the value of comparative sample 8-1 was set at 1.00.

Results are shown in Table 9.

TABLE 9

| Experiment No. | O/G ratio | Total coated amount of gelatin ($g/m^2$) | Remaining silver amount ($mg/m^2$) (A) | Light absorbance at 650 nm (B) | $B/A \times 10^{-3}$ | Print compensation (%) Y | M | C | ΔRMS |
|---|---|---|---|---|---|---|---|---|---|
| 8-1 | 0.75 | 18.0 | 777 | 0.53 | 0.68 | 0 | −5 | −10 | 1.00 |
| 8-2 | 0.70 | 18.5 | 819 | 0.50 | 0.61 | 0 | −5 | −5 | 0.93 |
| 8-3 | 0.70 | 18.0 | 821 | 0.49 | 0.60 | 0 | 0 | −5 | 0.68 |
| 8-4 | 0.70 | 14.0 | 765 | 0.48 | 0.63 | 0 | 0 | −5 | 0.63 |
| 8-5 | 0.70 | 13.5 | 809 | 0.46 | 0.57 | 0 | −5 | −10 | 0.92 |
| 8-6 | 0.50 | 18.5 | 831 | 0.48 | 0.58 | 0 | −5 | −5 | 0.82 |
| 8-7 | 0.50 | 18.0 | 769 | 0.45 | 0.59 | 0 | 0 | −5 | 0.66 |
| 8-8 | 0.50 | 14.0 | 770 | 0.42 | 0.55 | 0 | 0 | −5 | 0.60 |
| 8-9 | 0.50 | 13.5 | 793 | 0.55 | 0.69 | 0 | 0 | −10 | 0.81 |
| 8-10 | 0.45 | 18.0 | 804 | 0.57 | 0.71 | 0 | −5 | −10 | 0.79 |

It is clear from the results in Table 9 that the effects of the invention can be more enhanced when the ratio of the total weigh of oleophilic photographic components/weight of gelatin in the silver halide photographic light-sensitive material is from 0.50 to 0.70 and the total coated amount of gelatin is 14.0 $g/m^2$ to 18. 0 $g/m^2$.

It is understood from the above-mentioned that a suitable print can be obtained according to the invention without formation any color remaining stain or lines, and degradation of image quality even when the coated silver halide is remained in the light-sensitive material.

Example 9

Experiments were performed in the same manner as in Example 1 except that fixing solutions were used in which the ratio of ammonium ion to the total cations in the fixing solution was changed as shown in Table 10 by replacing ammonium ion by sodium ion, and the film used for forming a converged condition is changed to Color Negative Film LV100, manufactured by Konica Corp. Prints were prepared using thus obtained negative and the compensation for printing were carried out. ΔRMS was also measured and shown as the relative value when the value of comparative sample 9-1-1 was set at 1.00. Results are shown in Table 10.

TABLE 10

| Sample No. | $NH_4$ ratio (%) | Remaining silver amount $mg/m^2$ (A) | Light absorbance at 650 nm (B) | $A/B \times 10^{-3}$ | Print compensation (%) Y | M | C | ΔRMS | Note |
|---|---|---|---|---|---|---|---|---|---|
| 9-1-1 | 100 | 80 | 0.63 | 7.88 | −5 | −5 | −25 | 1.00 | Comp. |
| 9-1-2 | 75 | 120 | 0.76 | 6.33 | −5 | −5 | −25 | 1.09 | Comp. |

TABLE 10-continued

| Sample No. | $NH_4$ ratio (%) | Remaining silver amount mg/m$^2$ (A) | Light absorbance at 650 nm (B) | A/B × $10^{-3}$ | Print compensation (%) Y | M | C | ΔRMS | Note |
|---|---|---|---|---|---|---|---|---|---|
| 9-1-3 | 50 | 490 | 0.97 | 1.98 | −10 | −20 | −40 | 1.38 | Comp. |
| 9-1-4 | 25 | 700 | 1.12 | 1.60 | −10 | −20 | −40 | 1.44 | Comp. |
| 9-7-1 | 100 | 390 | 0.40 | 1.03 | 0 | 0 | −5 | 0.60 | Inv. |
| 9-7-2 | 75 | 690 | 0.43 | 0.62 | 0 | 0 | −5 | 0.65 | Inv. |
| 9-7-3 | 50 | 808 | 0.47 | 0.58 | 0 | 0 | −10 | 0.68 | Inv. |
| 9-7-4 | 25 | 1057 | 0.53 | 0.50 | 0 | −5 | −10 | 0.72 | Inv. |

As is cleared in the results in Table 10, the effects of the invention is considerably realized when the ratio of ammonium ion to the total cations is not more than 50%.

Example 10

Experiments were performed in the same manner as in No. 1 Example 1 except that the ratio of the circulating amount to the volume of processing tank (the circulation amount/processing tank volume=circulating ratio) was varied as shown in Table 11 by controlling the circulating amount in the fixing tank and the fixing tank, and the fixing tank according to two tank counter-current system was modified to single tank system while the fixing time was not changed. Prints were prepared using thus obtained negative and the compensation for printing were carried out. ΔRMS was also measured and shown as the relative value when the value of comparative sample 10-1-1 was set at 1.00. Results are shown in Table 11.

TABLE 11

| Sample No. | Circulating ratio | Remaining silver amount mg/m$^2$ (A) | Light absorbance at 650 nm (B) | A/B × $10^{-3}$ | Print compensation (%) Y | M | C | ΔRMS | Note |
|---|---|---|---|---|---|---|---|---|---|
| 10-1-1 | 0.1 | 819 | 1.36 | 1.66 | −10 | −20 | −50 | 1.00 | Comp. |
| 10-1-2 | 0.2 | 669 | 1.10 | 1.64 | −10 | −15 | −45 | 0.93 | Comp. |
| 10-1-3 | 0.4 | 423 | 0.89 | 2.10 | −10 | −15 | −40 | 0.69 | Comp. |
| 10-1-4 | 0.8 | 315 | 0.76 | 2.41 | −10 | −10 | −35 | 0.68 | Comp. |
| 10-1-5 | 1.0 | 222 | 0.55 | 2.48 | −10 | −10 | −20 | 0.55 | Comp. |
| 10-7-1 | 0.1 | 1425 | 0.70 | 0.49 | −10 | −10 | −10 | 0.50 | Inv. |
| 10-7-2 | 0.2 | 1003 | 0.45 | 0.49 | −5 | −5 | −5 | 0.40 | Inv. |
| 10-7-3 | 0.4 | 954 | 0.42 | 0.44 | 0 | −5 | −5 | 0.37 | Inv. |
| 10-7-4 | 0.8 | 801 | 0.37 | 0.46 | 0 | −5 | −5 | 0.37 | Inv. |
| 10-7-5 | 1.0 | 724 | 0.33 | 0.46 | 0 | −5 | −5 | 0.38 | Inv. |

As is cleared in the results in Table 11, the effects of the invention is considerably enhanced when the circulating ratio in the fixing tank is within the range of from 0.2 to 0.8.

Example 11

This example was performed using the following automatic processor, processing conditions and processing solutions.

(Automatic processor)

A color negative processor CL-KP-50QA, manufactured by Konica Corp., was modified and used.

(Treatment processes)

(Treatment processes)

| | Processing time | Processing temperature |
|---|---|---|
| Color developing | 3 min. 15 sec. | 38° C. |
| Bleaching | 45 sec. | 38° C. |
| Fixing-1 | 45 sec. | Show Table 1 |
| Fixing-2 | 45 sec. | Show Table 1 |
| Stabilizing-1 | 20 sec. | 38° C. |
| Stabilizing-2 | 20 sec. | 38° C. |
| Stabilizing-3 | 20 sec. | 38° C. |
| Drying | 1 min. 30 sec. | 65° C. |

-continued

| (Receipt of processing solutions) Color developing solution: per 1 liter | |
|---|---|
| Sodium sulfite | 5.0 g |
| Sodium carbonate | 35.0 g |
| Pentasodium diethylenetriaminepentaacetate | 4.0 g |
| Hydroxylamine sulfate | 3.0 g |
| Potassium bromide | 1.5 g |
| Potassium iodide | 2.0 mg |
| 4-amino-3-methyl-N-ethyl-(β-hydroxyethyl)aniline sulfate | 4.5 g |

Make up to 1 liter by water and adjust pH to 10.0 using potassium hydroxide or 50% sulfuric acid.

| Bleaching solution: per 1 liter | Using solution | Re-plenisher |
|---|---|---|
| Ammonium ferric 1,3-propylenediaminetetraacetate | | 133 g |
| 1,3-propylenediaminetetraacetic acid | | 5 g |
| Ammonium bromide | | 60 g |
| Maleic acid | | 40 g |
| Imidazole | | 10 g |

Make up to 1 liter by water, and adjust pH to 4.3 using aqueous ammonia or 20% sulfuric acid.

| Fixing solution: per 1 liter | |
|---|---|
| Ammonium thiosulfate | 180 g |
| Sodium thiosulfate | 20 g |
| Sodium sulfite | 18 g |
| Disodium ethylenediaminetetraacetate | 2 g |
| Compound shown in Table 12 (additive) | 0.01 moles |
| Silver bromide | 0.15 moles |
| Silver iodide | 0.008 moles |

Make up to 1 liter by water, and adjust pH to 6.5 using aqueous ammonia or 20% sulfuric acid.

| Stabilizing solution: per 1 liter | |
|---|---|
| m-hydroxybenzaldehyde | 1.5 g |
| Disodium ethylenediaminetetraacetate | 0.6 g |
| β-cyclodextrin | 0.2 g |
| Potassium carbonate | 0.2 g |

Make up to 1 liter by water.

The light-sensitive material prepared in Example 1 was exposed to light through an optical wedge in an ordinary manner and processed by the above-mentioned conditions. The additives to the fixing solution (added amount was 0.01 moles/liter in all tests), the circulating amount in the fixing process and the processing temperature were changed as shown in Table 12. Thus processed Samples 1 through 14 were prepared, in each of which monovalent silver is remained in a ratio shown in Table 12 to the silver amount in the light-sensitive material before processing. To the fixing solution for preparing Sample 14, I-10 and I-23 were each added in an mount of 0.005 moles/l, respectively.

TABLE 12

| Sample No. | Additive in fixing solution | Circulating amount of processing solution (1/min.) | Processing temperature (° C.) | Remained amount of silver (% by weight) |
|---|---|---|---|---|
| 1 | None | 15 | 40 | 0.7 |
| 2 | None | 7 | 38 | 9.8 |
| 3 | 1-9 | 10 | 38 | 9.7 |
| 4 | I-10 | 10 | 38 | 9.4 |
| 5 | I-13 | 10 | 38 | 9.5 |
| 6 | I-22 | 10 | 38 | 9.5 |
| 7 | I-23 | 10 | 38 | 9.1 |
| 8 | I-10 | 15 | 45 | 0.8 |
| 9 | I-10 | 15 | 43 | 1.2 |
| 10 | I-10 | 15 | 38 | 2.1 |
| 11 | I-10 | 7 | 38 | 14.8 |
| 12 | I-10 | 4 | 38 | 49.5 |
| 13 | I-10 | 3.8 | 38 | 51.3 |
| 14 | I-10 & I-23 | 10 | 38 | 9.3 |

Samples 1 through 14 were stored at a dark place for 10 days at 75° C. and a relative humidity of 10%. Increasing of transmission density at 440 nm (yellow stain) at a portion having a density of 1.0 and decreasing of transmission density at 550 nm (decoloring ratio of magenta) after the storage were measured for all the samples. A negative value of the decoloring rate of magenta means increasing of the density. Smaller value of the yellow stain density and the magenta decoloring ratio are corresponding to higher stability and good properties. Results are shown in Table 13.

TABLE 13

| Experiment No. | Additive in fixing solution | Remained silver ratio (% by weight) | Yellow stain density | Magenta decoloring ratio (%) | Note |
|---|---|---|---|---|---|
| 2-1 | None | 0.7 | 0.25 | 54 | Comp. |
| 2-2 | None | 9.8 | 0.43 | 39 | Comp. |
| 2-3 | I-9 | 9.7 | 0.08 | 12 | Inv. |
| 2-4 | I-10 | 9.4 | 0.03 | 8 | Inv. |
| 2-5 | I-13 | 9.5 | 0.05 | 5 | Inv. |
| 2-6 | I-22 | 9.5 | 0.08 | 13 | Inv. |
| 2-7 | I-23 | 9.1 | 0.05 | 9 | Inv. |
| 2-8 | I-10 | 0.8 | 0.12 | 45 | Comp. |
| 2-9 | I-10 | 1.2 | 0.00 | 19 | Inv. |
| 2-10 | I-10 | 2.1 | 0.02 | 10 | Inv. |
| 2-11 | I-10 | 14.8 | 0.06 | −5 | Inv. |
| 2-12 | I-10 | 48.5 | 0.12 | −9 | Inv. |
| 2-13 | I-10 | 52.3 | 0.20 | −18 | Comp. |
| 2-14 | I-10 & II23 | 9.3 | 0.03 | 9 | Inv. |

It is clear from the results in Table 2 that the increase of the yellow stain density and the decoloring of magenta dye can be reduced by adding the compound represented by Formula (I) and remaining silver in the light-sensitive material in a ratio of from 1 to 50% by weight of the coated silver halide.

We claim:

1. A method for processing a transparent silver halide color photographic material comprises the step of treating the transparent silver halide photographic light-sensitive material with a processing solution containing a compound represented by Formula (I), wherein after the treating, a ratio (E/G) of a light absorbance E of unexposed area of the light-sensitive material at 650 nm to an amount of silver G mg/m$^2$ remaining in the light-sensitive material is within the range of from $3.0\times10^{-4}$ to $1.5\times10^{-3}$ in the silver halide photogrpahic light-sensitive material,

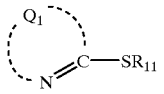

wherein Q is a group of atoms necessary for forming a nitrogen-containing heterocyclic ring (including one condensed with a 5- or 6-member unsaturated ring), $R_{11}$ is a hydrogen atom, an alkali metal atom,

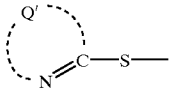

or an alkyl group, Q' is a synonym for $Q_1$.

2. The method of claim 1 wherein the processing solution is selected from a group consisting of a processing solution having a bleaching ability, a processing solution having a fixing ability and a stabilizing solution.

3. The method of claim 1 wherein the processing solution is a bleaching solution or a fixing solution.

4. The method of claim 1 wherein an amount of the compound represented by Formula (I) is from 0.0001 to 0.1 moles/liter.

5. The method of claim 1 wherein the processing solution is a fixing solution and replenishing amount for the fixing solution is not more than 90ml/$m^2$.

6. The method of claim 1 wherein the processing solution is a fixing solution and the ratio of ammonium ion to the total cations is not more than 50% in the fixing solution.

7. The method of claim 1 wherein the processing solution is a fixing solution and circulating ratio in the fixing tank is from 0.2 to 0.8.

8. A transparent silver halide color photographic material wherein the material is processed by step of treating the transparent silver halide photographic light-sensitive material with a processing solution containing a compound represented by Formula (I), wherein after the treating, a ratio (E/G) of a light absorbance E of unexposed area of the light-sensitive material at 650 nm to an amount of silver G mg/$m^2$ remaining in the light-sensitive material is within the range of from $3.0\times10^{-4}$ to $1.5\times10^{-3}$in the silver halide photogrpahic light-sensitive material,

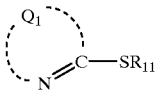

wherein Q is a group of atoms necessary for forming a nitrogen-containing heterocyclic ring (including one condensed with a 5- or 6-member unsaturated ring), $R_{11}$ is a hydrogen atom, an alkali metal atom,

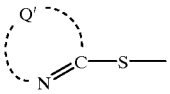

or an alkyl group, Q' is a synonym for $Q_1$.

9. A transparent silver halide color photographic material containing a complex composed of the compound represented by Formula (I) and silver.

10. The transparent silver halide color photographic material of claim 9 wherein an amount of the complex is 1 to 10 mg converted to silver.

* * * * *